US007890028B2

(12) United States Patent
Miyamoto et al.

(10) Patent No.: US 7,890,028 B2
(45) Date of Patent: Feb. 15, 2011

(54) DEVELOPING DEVICE AND IMAGE FORMING APPARATUS COMPRISING THE SAME

(75) Inventors: Satoru Miyamoto, Kanagawa (JP); Koichi Sakata, Kanagawa (JP); Maiko Koeda, Shizuoka (JP); Kiyonori Tsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 720 days.

(21) Appl. No.: 11/853,490

(22) Filed: Sep. 11, 2007

(65) Prior Publication Data

US 2008/0063433 A1 Mar. 13, 2008

(30) Foreign Application Priority Data

Sep. 13, 2006 (JP) ..... 2006-248746

(51) Int. Cl.
*G03G 15/09* (2006.01)

(52) U.S. Cl. ..... 399/267; 399/274; 399/272

(58) Field of Classification Search ..... None
See application file for complete search history.

(56) References Cited

U.S. PATENT DOCUMENTS

| | | | |
|---|---|---|---|
| 5,380,616 | A | 1/1995 | Aoki et al. |
| 5,659,860 | A | 8/1997 | Sasaki et al. |
| 5,758,241 | A | 5/1998 | Oyama et al. |
| 5,771,426 | A | 6/1998 | Oka et al. |
| 5,771,429 | A | 6/1998 | Oyama et al. |
| 5,805,965 | A | 9/1998 | Tsuda et al. |
| 5,822,664 | A | 10/1998 | Oka et al. |
| 5,840,456 | A | 11/1998 | Tomita et al. |
| 5,878,313 | A * | 3/1999 | Takagi et al. ..... 399/279 |

(Continued)

FOREIGN PATENT DOCUMENTS

| | | |
|---|---|---|
| JP | 2000-75541 | 3/2000 |

(Continued)

OTHER PUBLICATIONS

U.S. Appl. No. 12/059,392, filed Mar. 31, 2008, Takeyama, et al.

(Continued)

*Primary Examiner*—David M Gray
*Assistant Examiner*—Roy Yi
(74) *Attorney, Agent, or Firm*—Oblon, Spivak, McClelland, Maier & Neustadt, L.L.P.

(57) ABSTRACT

A developing device and image forming apparatus that can satisfy stability over time in relation to amount of developer carried, and prevent developer retention, deterioration of developer and developing sleeve adhesion, wherein the amount of developer carried per unit area on the developer carrier in the developing region is 30 mg/cm$^2$ to 60 mg/cm$^2$; the weight mean particle diameter of the toner is 4.5 μm to 8.0 μm; the ratio Dw/Dn of the toner weight mean particle diameter (Dw) and the number mean particle diameter (Dn) is 1.20 or less; an irregular roughness pattern having the maximum height Rz of the surface roughness of 20 to 40 μm and the mean space Sm of the roughness of 100 to 200 μm is formed on the surface of the developer carrier; and the relationship between the developing gap PG and the gap DG between the developer restricting member and the developer carrier is $1.0 \leqq (DG/PG) \leqq 3.0$.

12 Claims, 9 Drawing Sheets

U.S. PATENT DOCUMENTS

| | | | | |
|---|---|---|---|---|
| 5,915,155 | A | 6/1999 | Shoji et al. | |
| 5,919,592 | A | 7/1999 | Yaguchi et al. | |
| 5,998,074 | A | 12/1999 | Miyamoto et al. | |
| 5,999,772 | A | 12/1999 | Kakitani et al. | |
| 6,198,895 | B1 | 3/2001 | Tsuda et al. | |
| 6,337,957 | B1 | 1/2002 | Tamaki et al. | |
| 6,355,389 | B1 | 3/2002 | Miyamoto | |
| 6,432,590 | B1 | 8/2002 | Ueda et al. | |
| 6,522,855 | B1 | 2/2003 | Katoh et al. | |
| 6,593,048 | B2 | 7/2003 | Sasaki et al. | |
| 6,667,141 | B2 | 12/2003 | Iwamoto et al. | |
| 6,699,632 | B2 | 3/2004 | Higuchi et al. | |
| 6,790,575 | B2 | 9/2004 | Sasaki et al. | |
| 6,835,517 | B2 | 12/2004 | Kondo et al. | |
| 6,856,774 | B2 | 2/2005 | Sampe et al. | |
| 6,856,781 | B2 | 2/2005 | Matsuda et al. | |
| 6,873,814 | B2 | 3/2005 | Ohjimi et al. | |
| 6,911,289 | B2 | 6/2005 | Higuchi et al. | |
| 6,924,073 | B2 | 8/2005 | Higuchi et al. | |
| 6,934,484 | B2 | 8/2005 | Suzuki et al. | |
| 6,947,692 | B2 | 9/2005 | Kondo et al. | |
| 7,003,255 | B2 | 2/2006 | Kawasumi et al. | |
| 7,024,133 | B2 | 4/2006 | Nagashima et al. | |
| 7,056,636 | B2 | 6/2006 | Tomita et al. | |
| 7,062,207 | B2 | 6/2006 | Tsuda et al. | |
| 7,072,602 | B2 | 7/2006 | Hatori et al. | |
| 7,076,192 | B2 | 7/2006 | Tsuda et al. | |
| 7,083,890 | B2 | 8/2006 | Emoto et al. | |
| 7,129,013 | B2 | 10/2006 | Higuchi et al. | |
| 7,136,610 | B2 | 11/2006 | Arai et al. | |
| 7,146,122 | B2 | 12/2006 | Hatori et al. | |
| 7,157,199 | B2 | 1/2007 | Emoto et al. | |
| 7,157,201 | B2 | 1/2007 | Tomita et al. | |
| 7,162,189 | B2 | 1/2007 | Tsuda et al. | |
| 7,169,525 | B2 | 1/2007 | Sugiura et al. | |
| 7,172,844 | B2 | 2/2007 | Umemura et al. | |
| 7,184,691 | B2 | 2/2007 | Kita et al. | |
| 7,212,767 | B2 | 5/2007 | Hosokawa et al. | |
| 7,258,959 | B2 | 8/2007 | Nakayama et al. | |
| 7,261,989 | B2 | 8/2007 | Sugiura et al. | |
| 2003/0178514 | A1 | 9/2003 | Makino et al. | |
| 2004/0223790 | A1 | 11/2004 | Hosokawa et al. | |
| 2004/0265015 | A1* | 12/2004 | Koike et al. | 399/274 |
| 2005/0002701 | A1* | 1/2005 | Ikeguchi et al. | 399/267 |
| 2005/0026064 | A1 | 2/2005 | Sugiura et al. | |
| 2005/0089786 | A1 | 4/2005 | Sugiura et al. | |
| 2005/0089787 | A1 | 4/2005 | Uchinokura et al. | |
| 2005/0141919 | A1 | 6/2005 | Kitajima et al. | |
| 2005/0158644 | A1 | 7/2005 | Kondo et al. | |
| 2005/0181291 | A1 | 8/2005 | Kami et al. | |
| 2005/0191575 | A1 | 9/2005 | Sugiura et al. | |
| 2005/0208408 | A1 | 9/2005 | Uchinokura et al. | |
| 2005/0208411 | A1 | 9/2005 | Nakayama et al. | |
| 2005/0226656 | A1 | 10/2005 | Tsuda et al. | |
| 2006/0029433 | A1 | 2/2006 | Saito et al. | |
| 2006/0051136 | A1 | 3/2006 | Tsuda et al. | |
| 2006/0057479 | A1 | 3/2006 | Niimi et al. | |
| 2006/0083555 | A1 | 4/2006 | Uchiyama et al. | |
| 2006/0093946 | A1 | 5/2006 | Miyamoto et al. | |
| 2006/0099009 | A1 | 5/2006 | Miyamoto et al. | |
| 2006/0120767 | A1 | 6/2006 | Miyamoto et al. | |
| 2006/0134540 | A1 | 6/2006 | Kondo et al. | |
| 2006/0154168 | A1 | 7/2006 | Tomita et al. | |
| 2006/0177749 | A1 | 8/2006 | Tamoto et al. | |
| 2006/0204883 | A1 | 9/2006 | Nakayama et al. | |
| 2007/0020546 | A1 | 1/2007 | Emoto et al. | |
| 2007/0031748 | A1 | 2/2007 | Kotsugai et al. | |
| 2007/0081835 | A1 | 4/2007 | Tsuda et al. | |
| 2007/0116494 | A1 | 5/2007 | Uno et al. | |
| 2007/0140747 | A1 | 6/2007 | Kita et al. | |
| 2007/0160392 | A1 | 7/2007 | Tsuda et al. | |

FOREIGN PATENT DOCUMENTS

| | | |
|---|---|---|
| JP | 2002-91053 | 3/2002 |
| JP | 2002-258609 | 9/2002 |
| JP | 2003-177602 | 6/2003 |
| JP | 2004-109284 | 4/2004 |
| JP | 2005-37878 | 2/2005 |
| JP | 2005-62476 | 3/2005 |
| JP | 2006-23783 | 1/2006 |
| JP | 2006-47942 | 2/2006 |

OTHER PUBLICATIONS

U.S. Appl. No. 12/110,055, filed Apr. 25, 2008, Sakata, et al.
U.S. Appl. No. 12/114,164, filed May 2, 2008, Matsumoto, et al.
U.S. Appl. No. 12/166,951, filed Jul. 2, 2008, Miyamoto, et al.
U.S. Appl. No. 09/148,509, filed Sep. 4, 1998, Yohtaro Kakitani, et al.
U.S. Appl. No. 09/384,797, filed Aug. 27, 1999, Satoru Miyamoto, et al.
U.S. Appl. No. 10/793,320, filed Mar. 5, 2004, Hiroto Higuchi, et al.
U.S. Appl. No. 11/612,865, filed Dec. 19, 2006, Kiyonori Tsuda, et al.
U.S. Appl. No. 12/194,649, filed Aug. 20, 2008, Kita, et al.
U.S. Appl. No. 12/235,135, filed Sep. 22, 2008, Kato, et al.
U.S. Appl. No. 12/238,815, filed Sep. 26, 2008, Utsunomiya, et al.
U.S. Appl. No. 12/250,046, filed Oct. 13, 2008, Tsuda.
U.S. Appl. No. 12/252,693, filed Oct. 16, 2008, Sakata.

* cited by examiner

FIG. 10

| | CARRIER | CARRIER VOLUME SPECIFIC RESISTANCE | CORE MATERIAL SURFACE COVERAGE PERCENTAGE | INORGANIC MICROPARTICLE SPECIFIC RESISTANCE |
|---|---|---|---|---|
| | | log Ω · cm | % | log Ω · cm |
| EXAMPLES 1 ~ 6 COMPARATIVE EXAMPLES 1 ~ 7 | CARRIER 1 | 15.9 | 93 | $10^{12}$ |
| EXAMPLE 7 | CARRIER 2 | 14.5 | 83 | $10^{13}$ |
| EXAMPLE 8 | CARRIER 3 | 11.2 | 83 | $10^{8}$ |
| EXAMPLE 9 | CARRIER 4 | 15.7 | 83 | $10^{13}$ |
| EXAMPLE 10 | CARRIER 5 | 14.5 | 71 | $10^{13}$ |

FIG. 11

| 5% 1P/J | DG/PG | INITIAL QUALITY | | | | QUALITY AFTER 100K SHEETS OF IMAGE | | | | | |
|---|---|---|---|---|---|---|---|---|---|---|---|
| | | Q/M | TC | AMOUNT OF DEVELOPER CARRIED | HIGHRIGHT UNIFORMITY | Q/M | TC | AMOUNT OF DELEVOPER CARRIED | HIGHRIGHT UNIFORMITY | TONER SCATTERING | DEVELOPER DROPPED |
| | | $-\mu C/g$ | wt% | $mg/cm^2$ | | $-\mu C/g$ | wt% | $mg/cm^2$ | ランク | mg | |
| EXAMPLE 1 | 2.0 | 29 | 5.10 | 35 | 7 | 33 | 4.81 | 34 | 7 | 40 | ○ |
| EXAMPLE 2 | 2.0 | 32 | 5.07 | 40 | 8 | 35 | 5.23 | 35 | 8 | 68 | ○ |
| EXAMPLE 3 | 2.0 | 35 | 5.13 | 45 | 9 | 36 | 5.21 | 40 | 8 | 79 | ○ |
| EXAMPLE 4 | 1.0 | 35 | 5.13 | 30 | 8 | 28 | 5.45 | 24 | 8 | 158 | ○ |
| EXAMPLE 5 | 3.0 | 35 | 5.13 | 50 | 9 | 38 | 4.76 | 48 | 8 | 51 | ○ |
| EXAMPLE 6 | 3.0 | 35 | 5.13 | 60 | 8 | 38 | 4.38 | 57 | 8 | 38 | ○ |
| EXAMPLE 7 | 2.0 | 33 | 5.11 | 45 | 9 | 35 | 5.55 | 40 | 8 | 85 | ○ |
| EXAMPLE 8 | 2.0 | 30 | 5.05 | 45 | 9 | 32 | 4.73 | 42 | 8 | 121 | ○ |
| EXAMPLE 9 | 2.0 | 36 | 5.05 | 58 | 9 | 38 | 5.78 | 52 | 8 | 32 | ○ |
| EXAMPLE 10 | 2.0 | 29 | 5.10 | 32 | 7 | 27 | 4.41 | 30 | 7 | 135 | ○ |
| EXAMPLE 11 | 2.0 | 31 | 5.06 | 43 | 9 | 30 | 4.88 | 40 | 8 | 89 | ○ |
| COMPARATIVE EXAMPLE 1 | 0.8 | 29 | 5.10 | 45 | 6 | 30 | 8.81 | 33 | 3 | 1329 | ○ |
| COMPARATIVE EXAMPLE 2 | 0.8 | 32 | 5.07 | 50 | 6 | 28 | 8.21 | 42 | 3 | 1003 | ○ |
| COMPARATIVE EXAMPLE 3 | 0.8 | 35 | 5.13 | 55 | 6 | 30 | 7.78 | 47 | 3 | 864 | ○ |
| COMPARATIVE EXAMPLE 4 | 1.0 | 35 | 5.13 | 25 | 5 | 28 | 8.35 | 18 | 2 | 1259 | ○ |
| COMPARATIVE EXAMPLE 5 | 3.0 | 35 | 5.13 | 65 | 4 | 30 | 6.51 | 58 | 1 | 539 | ○ |
| COMPARATIVE EXAMPLE 6 | 3.6 | 35 | 5.13 | 60 | 4 | 37 | 5.39 | 55 | 1 | 521 | × |
| COMPARATIVE EXAMPLE 7 | 2.0 | 36 | 5.04 | 30 | 3 | 24 | 7.69 | 15 | 1 | 956 | × |

DEVELOPING DEVICE AND IMAGE FORMING APPARATUS COMPRISING THE SAME

BACKGROUND OF THE INVENTION

1. Field of the Invention

The present invention relates to a developing device having a two-component developer including magnetic particles and toner, and to an image forming apparatus comprising the same.

2. Description of the Related Art

Well known in the past are developing devices that supported a two-component developer comprising non-magnetic toner particles and magnetic carrier particles on the surface of a developer carrier and used two-component developer to developed electrostatic latent images formed corresponding to the image information on a photoconductive member that was the image carrier. This developing device transported and supplied developer, which formed a so-called magnetic brush on the surface of the developer carrier, to the vicinity of the surface of a photoconductive member that supported the electrostatic latent image, and by applying DC developing bias (causing AC component superimposition as necessary) to the developer carrier which faced the photoconductive member while maintaining a minute gap, developed and manifested the electrostatic latent image with toner particles from the developer carrier side to the photoconductive member side.

The developer carrier of the brush type developing devices that develop images by forming a magnetic brush in this way is commonly configured by a developing sleeve formed in a cylindrical shape, and a magnetic roller comprising multiple magnetic poles arranged in the interior of the developing sleeve. This magnetic roller is for the purpose of forming a magnetic field that makes spikes of developer stand on the surface of the developing sleeve. The spikes of developer are transported to the surface of the developing sleeve by the relative movement of the developing sleeve in relation to this magnetic roller. In the developing region, the developer on the developing sleeve spikes up along the lines of magnetic force generated from developer magnetic poles that the magnetic roller has. The developer that is spiked up and formed into a brush shape flexibly makes contact with the surface of the developer carrier in association with the movement of the surface of the developing sleeve, and supplies toner to the electrostatic latent image.

Moreover, there may be various types of developing sleeves that carry the developer, but the type generally used is the one in which the surface of the developing sleeve has been roughened. Making multiple grooves extending longitudinally on the surface, and such processes as sandblasting, etc. to contour the surface may be used as the processes to roughen the surface of the developing sleeve. In contrast with superior developer transport capacity, the former type that has grooves is prone to generate sleeve pitch concentration irregularities on the image because increases and decreases of the amount of developer carried are produced in the sleeve circumferential direction in conjunction with the presence or absence of the grooves. Meanwhile, in the blast finish developing sleeve, the type of abnormal image described above is not produced in association with groove pitch, and therefore the blast finish sleeves are preferable in terms of achieving high image quality in an image forming apparatus that outputs full color images.

With the recent color advances in electronic photographic systems, the demand for high image quality and high reproducibility has become heightened. Yellow, magenta and cyan colored toners are used for full color electronic photographic toner. Further, black toner is also used as necessary. It is desirable that the particles of toner have a small particle size in order to obtain high resolution and clear images. However, reducing particle size produces the side effect of a notable decrease in fluidity in association with degradation of the developer.

This kind of decrease in developer fluidity appears to be produced by the following factors. Specifically, the developer on the developer carrier is restricted by a developer restricting member, thus restricting the amount of developer to be transported to the development region, but when passing through this developer restricting member, the developer undergoes large mechanical stress. This mechanical stress is a factor in burying the external additive, which was applied to the exterior of the toner in order to provide fluidity, and in scraping off the resin adhering to the surface of the carrier.

Because the developer transport capacity is weaker compared to developing sleeves having grooves, blast finished developing sleeves have a greater reduction in the amount of developer carried in association with this reduction of developer fluidity. As a result, the development capacity is reduced and the image concentration decreases. Countermeasures to suppress this kind of reduction in development capacity include: (1) increasing the linear velocity of the developing sleeve more than the linear velocity of the photoconductive member; (2) raising the development potential; and (3) heightening the toner concentration of the developer and reducing the electrostatic charge of the developer. However, when using countermeasure (1) of increasing the linear velocity of the developing sleeve more than the linear velocity of the photoconductive member, the developer rubs and abrades the photoconductive member in the development region, and the carrier produces frictional electrostatic charge with a reverse polarity to the toner, thus manifesting the problem of so-called "carrier adhesion", in which the carrier adheres to the photoconductive member. Moreover, when using countermeasure (2) of increasing the development potential, carrier with weak magnetic characteristics is developed on the photoconductive member, and the problem of carrier adhesion once again becomes manifest. In addition, the increase in the amount of charge passing through also raises the problem of shortening the working life of the photoconductive member. Moreover, when using countermeasure (3) of heightening the toner concentration of the developer and reducing the electrostatic charge of the developer, the problems of toner scattering and scum become manifest.

Anticipating a reduction in the amount of developer carried in association with the reduction of fluidity of the developer, the space between the developer restricting member and the developing sleeve may be pre-set wider, and the initial amount of developer carried may be set higher. However, simply setting the amount of developer carried higher will lead to supplying excessive developer to the development region, producing the so-call "developer retention" in which developer is retained between the photoconductive member and the developing sleeve. When this kind of developer retention is produced, developer drops from the ends of the developing sleeve. In addition, the developer retained between the photoconductive member and the developing sleeve receives stress between the photoconductive member and the developing sleeve, and developer adheres to the developing sleeve.

In addition, as a result of the increasing amount of developer supplied to the developing region, the length of the magnetic brush becomes longer, thereby lengthening the period of contact between the photoconductive member and the developer. Toner drift is prone to occur at the tip of the magnetic brush, wherein toner adhering to the surface of the carrier moves to the developing sleeve side by electrostatic force received from the non-latent image part during the period of facing the non-latent image part. Consequently, if the magnetic brush after undergoing toner drift rubs and abrades the back end of the latent image, the toner supply capacity decreases, and the so-called "scavenging phenomenon" occurs wherein the toner adhering to the back end of the latent image is electrostatically attracted and scratched away. Back end outlines and fine line reproducibility are reduced.

Specifically, recently increased linear velocity of the developing sleeve has been sought in conjunction with the development of high-speed image forming apparatuses, and all margin for scattering and sleeve adhesion, etc. is lost. Even more recently, the fixing unit has no oil coating function, and an oil-less color toner that contains releasing agent has also come on the market, but low boiling point releasing agent is prone to fuse to the surface of the developing sleeve, and from the perspective of guaranteeing the transport capacity of the developer, this is a disadvantage. In this way, in a color imaging for which image quality is emphasized, important technical issues in terms of supporting image quality over time include both stabilizing the amount of developer carried and handling high speeds.

For example, described in Japanese Patent Application Laid-open No. 2006-23783 (called Prior Art 1 hereinafter), is a technology in which the attenuation rate of the magnetic flux density in the normal direction of the developing sleeve surface of the main magnetic poles which cause the magnetic brush to spike up is 40% or more in the development region in order to prevent developer from adhering to blast-finished developing sleeves. The magnetic brush spike length can thereby be shortened, and a drop in back end outline and fine line reproducibility can be restricted when setting an initial high amount of amount developer carrier.

Moreover, described in Japanese Patent Application Laid-open No. 2005-62476 (called Prior Art 2 hereinafter), is a technology in which, an apparatus with a photoconductive member, a groove type developing sleeve, and a development gap G of 0.1 to 0.3 mm, the relationship $\rho/G$ between the amount of developer $\rho$ (mg/mm$^2$) supplied to the development region and the development gap G is less than 2.5 (mg/mm$^3$) in order to prevent "developer retention".

In addition, described in Japanese Patent Application Laid-open No. 2005-37878 (called Prior Art 3 hereinafter), is a technology that fulfills the relationship between the layer thickness Tup of the developer layer prior to the developer passing through the restricting member and the gap Gd between the developer restricting member and developing sleeve is $7<(Tup/Gd)<20$ in order to suppress degradation of the developer.

Nonetheless, the aforementioned Prior Art 1 cannot suppress "developer retention", and cannot suppress developer scattering and developer adhesion. Moreover, if the fluidity of the developer decreases and the amount of developer carried declines, then the concern arises that sufficient spike length cannot be formed and the concentration decreases, etc.

Moreover, if the grooves of the aforementioned Prior Art 2 are used in a blast type developer sleeve, the image concentration will decrease due to a drop in the amount of developer carried based on a reduction of developer fluidity.

In addition, the aforementioned Prior Art 3 cannot restrict "developer retention", and cannot suppress developer scattering and developer adhesion. In Prior Art 3, the period up to degradation of the developer can be extended, but when the developer degrades, the amount of developer carried decreases, reducing the image concentration.

In this way, no developing device in the past could address all the crucial aspects of developer retention, decreased developer fluidity and decreased amount of developer carried in order to guarantee high resolution, high grade images over a long period. Then, as a result of assiduous study, the inventors discovered the configuration of a developing device that could resolve all of the aforementioned issues. Specifically, by fulfilling the following conditions, developer retention, the decrease in developer fluidity, and the associated decreased amount of developer carried can be suppressed, and high grade images can be guaranteed over a long time.

(1) The amount of developer carried per unit area on the developer carrier in the developing region where toner on the developer carrier is moved to the image carrier side should be 30 [mg/cm$^2$] or more and 60 [mg/cm$^2$] or less.

(2) The toner weight mean particle diameter should be 4.5 [μm] or more and 8.0 [μm] or less, and the ratio [Dw/Dn] of the toner weight mean particle diameter (Dw) and the number mean particle diameter (Dn) should be 1.20 or less.

(3) The maximum height Rz of the surface roughness of the developer carrier should be 20 to 40 [μm], the mean space Sm of the roughness of the developer carrier surface should be 100 to 200 [μm], and the surface roughness of the developer carrier should have an irregular height and space roughness pattern.

(4) The value, which is obtained by dividing the gap DG between the developer carrier and a developer restricting member provided opposite to the developer carrier and restricting the amount of developer transported to the development region, by the developing gap PG between the image carrier and the developer carrier, should be 1.0 or more and 3.0 or less.

Technologies relating to the present invention are also disclosed in, e.g., Japanese Patent Application Laid-open No. 2003-177602, Japanese Patent Application Laid-open No. 2002-091053, and Japanese Patent Application Laid-open No. 2000-075541.

SUMMARY OF THE INVENTION

With the foregoing in view, an object of the present invention is to provide a developing device and an image forming apparatus comprising the same that suppresses developer retention, decreased developer fluidity, and the associated decreased amount of developer carried, and that can obtain high grade images over a long time period.

In an aspect of the present invention, a developing device comprises a developer carrier that is provided opposite to an image carrier supporting a latent image on the surface, that supports a two-component developer comprising magnetic particles and toner on the surface, and that forms a developing gap between the image carrier. The developing device develops the latent image by moving the toner on the developer carrier to the image carrier side. The amount of developer carried per unit area on the developer carrier is 30 [mg/cm$^2$] or more and 60 [mg/cm$^2$] or less in a developing region where toner on the developer carrier is moved to the image carrier side. The weight mean particle diameter of the toner is 4.5 [μm] or more and 8.0 [μm] or less, and the ratio [Dw/Dn] of the toner weight mean particle diameter (Dw) and the number mean particle diameter (Dn) is 1.20 or less. The maximum height Rz of the surface roughness of the developer carrier is 20 to 40 [μm], the mean space Sm of the roughness of the developer carrier surface is 100 to 200 [μm], and the surface roughness of the developer carrier has an irregular height and space roughness pattern. The value, which is obtained by dividing the gap DG between the developer carrier and a developer restricting member provided opposite to the developer carrier and restricting the amount of developer transported to the development region, by the developing gap PG between the image carrier and the developer carrier, is 1.0 or more and 3.0 or less.

In another aspect of the present invention, an image forming apparatus comprises a developing device. The developing device comprises a developer carrier that is provided opposite to an image carrier supporting a latent image on the surface, that supports a two-component developer comprising magnetic particles and toner on the surface, and that forms a developing gap between the image carrier. The developing device develops the latent image by moving the toner on the developer carrier to the image carrier side. The amount of developer carried per unit area on the developer carrier is 30 [mg/cm$^2$] or more and 60 [mg/cm$^2$] or less in a developing region where toner on the developer carrier is moved to the image carrier side. The weight mean particle diameter of the toner is 4.5 [μm] or more and 8.0 [μm] or less, and the ratio [Dw/Dn] of the toner weight mean particle diameter (Dw) and the number mean particle diameter (Dn) is 1.20 or less. The maximum height Rz of the surface roughness of the developer carrier is 20 to 40 [μm], the mean space Sm of the roughness of the developer carrier surface is 100 to 200 [μm], and the surface roughness of the developer carrier has an irregular height and space roughness pattern. The value, which is obtained by dividing the gap DG between the developer carrier and a developer restricting member provided opposite to the developer carrier and restricting the amount of developer transported to the development region, by the developing gap PG between the image carrier and the developer carrier, is 1.0 or more and 3.0 or less.

BRIEF DESCRIPTION OF THE DRAWINGS

The above and other objects, features and advantages of the present invention will become more apparent from the following detailed description taken with the accompanying drawings in which:

FIG. 10 a diagram indicating the characteristics of the carriers used in the embodiments of the present aspect and in the comparative examples; and FIG. 11 is a diagram indicating the main characteristics of the same embodiments and comparative examples.

DESCRIPTION OF THE PREFERRED EMBODIMENTS

An explanation will be given of an embodiment when using the present invention in a full color printer (called "printer" hereinafter), which is the image forming apparatus of an electronic photographic system.

Figure 1:
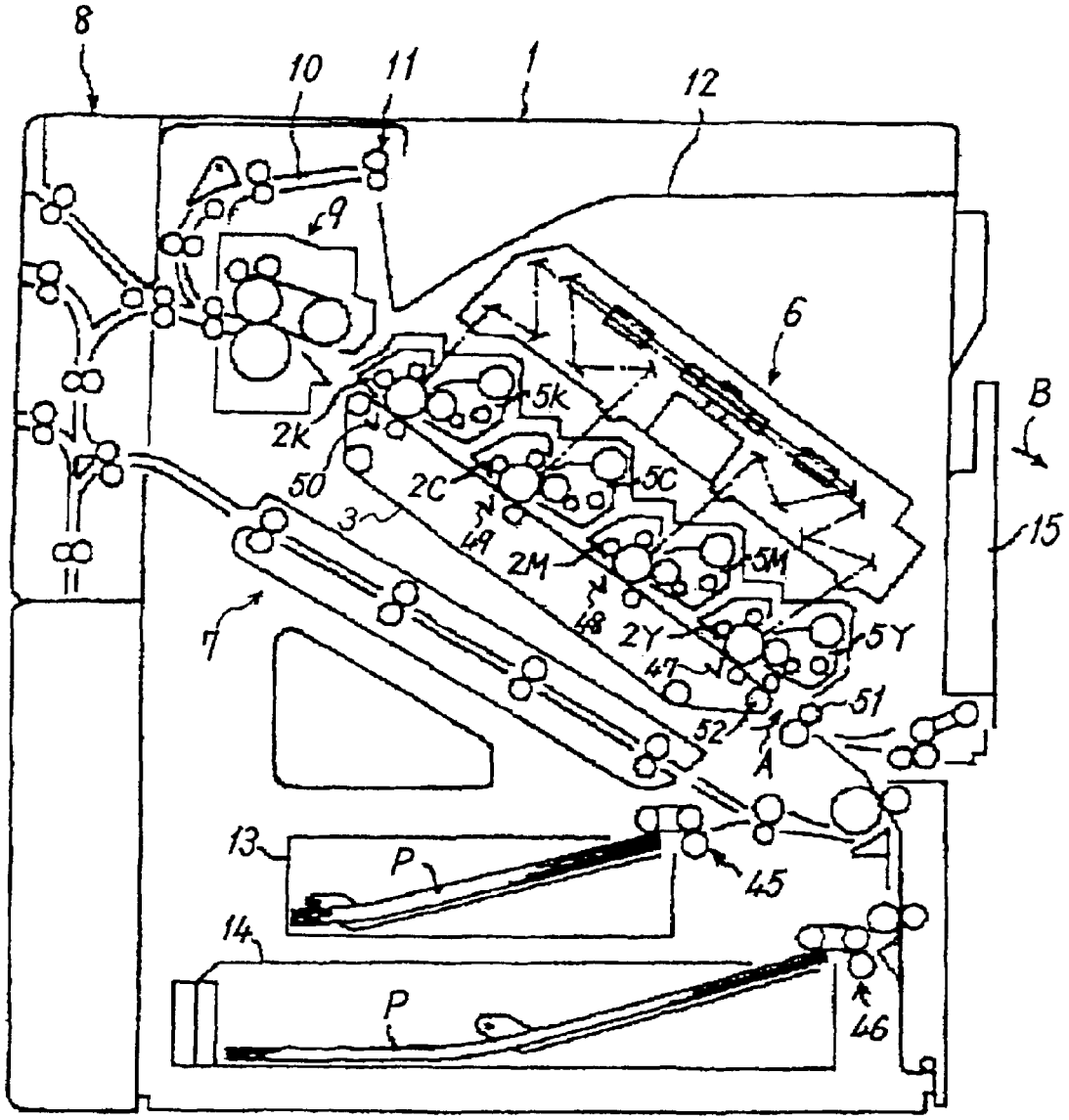
FIG. 1 is a diagram indicating the schematic configuration of a printer as an image forming apparatus relating to one embodiment of the present invention.

FIG. 1 indicates the schematic configuration of the interior of this printer. In FIG. 1, multiple removable photoconductive member units 2Y, 2M, 2C, and 2K are respectively mounted in the apparatus main unit 1 of a box-shaped apparatus main unit 1. A transfer belt 3, which slants diagonally to the apparatus main unit 1, is arranged in the central part of the apparatus main unit 1 as a recording material support member. The transfer belt 3 is hung around multiple rollers, including one to which rotational power can be transmitted, and can be driven rotationally in the direction of arrow A in the diagram.

The photoconductive member units 2Y, 2M, 2C, and 2K have drum-shaped photoconductive members 4Y, 4M, 4C, and 4K as image carriers, and are arranged above the transfer belt 3 so that the surfaces of the various photoconductive members make contact with the transfer belt 3. The array of photoconductive member units 2Y, 2M, 2C, and 2K are set up taking photoconductive member 2Y as the paper feed side, and have an order corresponding to 4Y, 4M, 4C, and 4K such that the photoconductive member 2K is positioned on the fixing apparatus 9 side. A belt-shaped photoconductive member or the like may also be used as the photoconductive members 4Y, 4M, 4C, and 4K, etc.

Developing devices 5Y, 5M, 5C, and 5K are arranged as developer supply means opposite photoconductive members 4Y, 4M, 4C, and 4K respectively. For example, the developing device 5Y develops by supplying two-component developer having yellow toner (called "Y" hereinafter) and carrier to the electrostatic latent image on photoconductive member 4Y. The developing device 5M develops by supplying two-component developer having magenta toner (called "M" hereinafter) and carrier to the electrostatic latent image on photoconductive member 4M. The developing device 5C develops by supplying two-component developer having cyan toner (called "C" hereinafter) and carrier to the electrostatic latent image on photoconductive member 4C. The developing device 5K develops by supplying two-component developer having black toner (called "K" hereinafter) and carrier to the electrostatic latent image on photoconductive member 4K.

A writing apparatus 6 is arranged as light exposure means above the photoconductive member units 2Y, 2M, 2C, and 2K, and a double-sided unit 7 is arranged below the photoconductive member units 2Y, 2M, 2C, and 2K. Paper supply units 13 and 14 that can store differing sizes of transfer material P are arranged below the double-sided unit 7. A reverse unit 8 is arranged to the left of the apparatus main unit 1, and manual tray 15 is provided on the right side of the apparatus main unit 1 so as to open and close in the direction of arrow B. A fixing apparatus 9 is arranged between the transfer belt 3 and the reverse unit 8. A reverse transport route 10 is formed branching downstream in the transfer material transport direction of the fixing apparatus 9. The reverse transport route 10 uses a discharge paper roller 11 arranged within the transport route to guide sheet-shaped transfer material P to a discharge paper tray 12 provided in the upper part of the apparatus.

The photoconductive member units 2Y, 2M, 2C, and 2K are units for forming Y, M, C, and K colored toner images on the photoconductive members 4Y, 4M, 4C, and 4K, and have the same configuration except for the location where arranged in the apparatus main unit 1. Here, the configuration of the photoconductive member unit 2Y will be explained.

Figure 2:
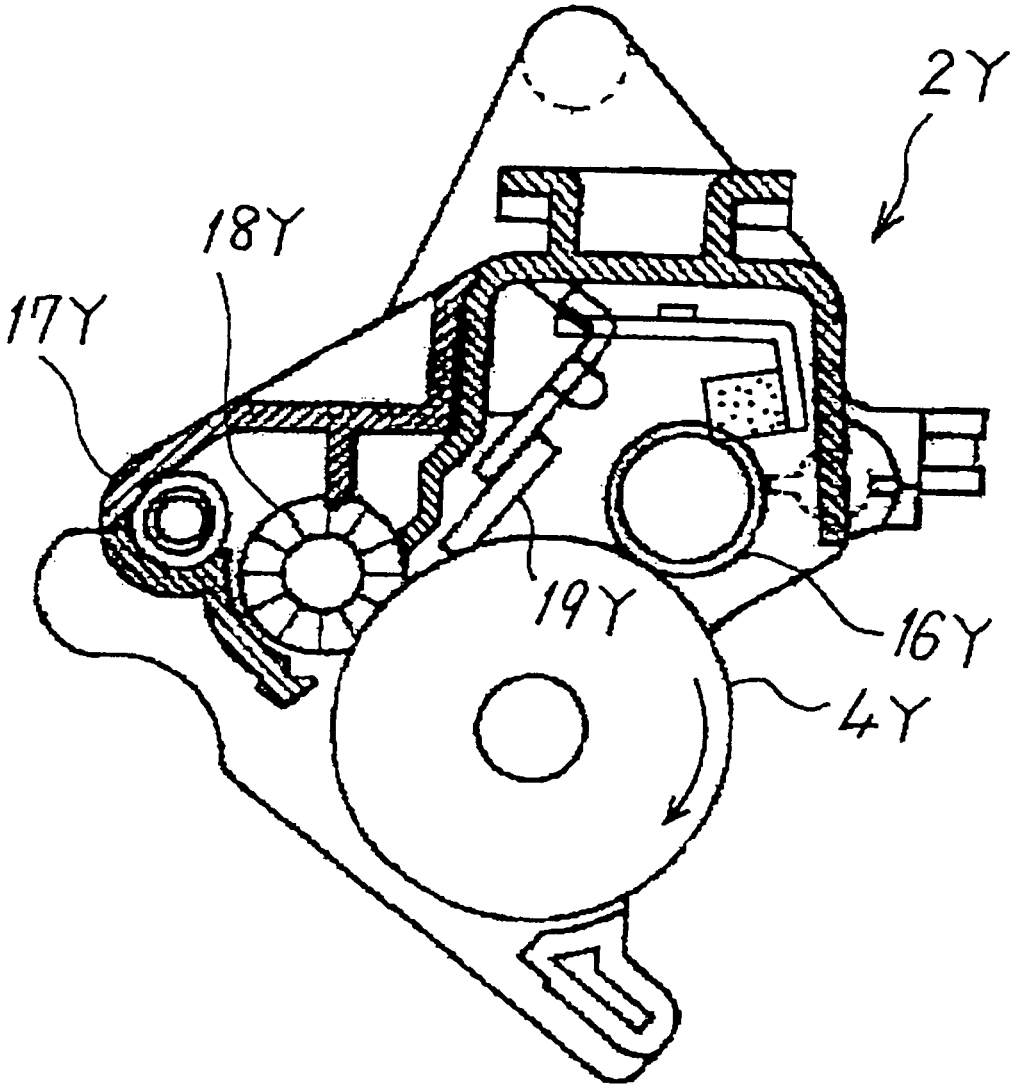
FIG. 2 is a diagram indicating the schematic configuration of a photoconductive member unit of the same printer.

FIG. 2 is a schematic configuration diagram indicating the interior configuration of the photoconductive member unit 2Y. As indicated in FIG. 2, the photoconductive member unit 2Y comprises the photoconductive member 4Y, an electrostatic roller 16Y that contacts the photoconductive member 4Y, and a cleaning apparatus 17Y that cleans the surface of the photoconductive member 4Y, and is installed in a removable manner in the apparatus main unit 1. The cleaning apparatus 17Y comprises a brush roller 18Y and a cleaning blade 19Y.

Figure 3:
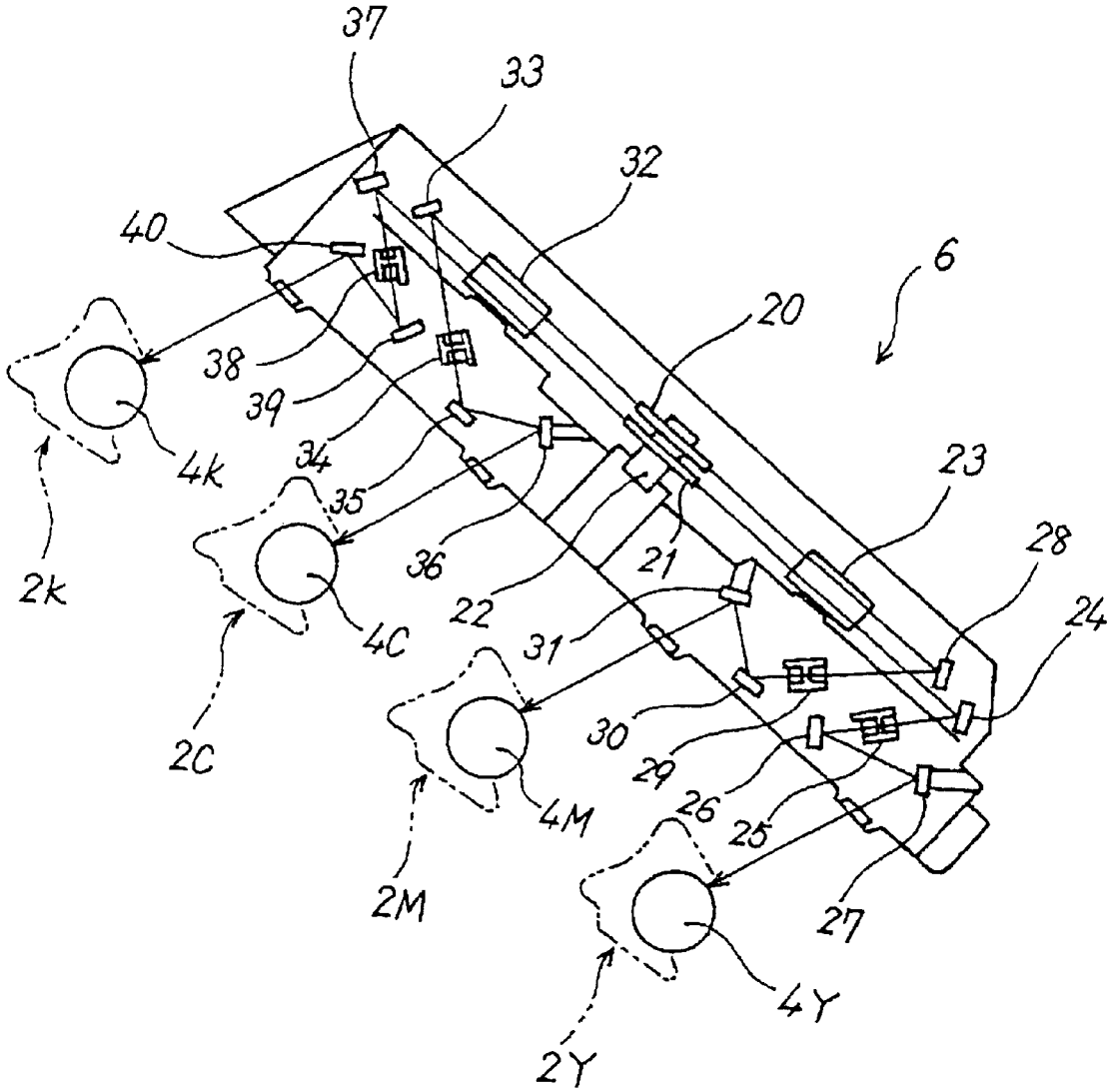
FIG. 3 is a diagram indicating the schematic configuration of the writing device of the same printer.

FIG. 3 indicates the schematic configuration of the writing apparatus 6. In the writing apparatus 6, two rotational poly-faceted mirrors 20 and 21 that are arranged on the same axis as indicated in FIG. 3 are made to rotate by a polygon motor 22. The rotational poly-faceted mirrors 20 and 21 separate out and reflect to the right and left Y laser light modulated by Y image data and M laser light modulated by M image data from two laser diodes (not indicated in the diagram) as the laser light sources, as well as C laser light modulated by C image data and K laser light modulated by K image data from two other laser diodes as the laser light sources. Y laser light and M laser light from the rotational poly-faceted mirrors 20 and 21 pass through a two layer fθ lens 23. After being reflected by a mirror 24 and passing through a long WTL 25, the Y laser light from this fθ lens 23 is irradiated on the photoconductive member 4Y of the photoconductive member unit 2Y via mirrors 26 and 27. After being reflected by a mirror 28 and passing through a long WTL 29, the M laser light from this fθ lens 23 is irradiated on the photoconductive member 4M of the photoconductive member unit 2M via mirrors 30 and 31. The C laser light and K laser light from the rotational poly-faceted mirrors 20 and 21 pass through a two layer fθ lens 32. After being reflected by a mirror 33 and passing through a long WTL 34, the C laser light from this fθ lens 32 is irradiated on the photoconductive member 4C of the photoconductive member unit 2C via mirrors 34 and 36. After being reflected by a mirror 37 and passing through a long WTL 38, the K laser light from this fθ lens 32 is irradiated on the photoconductive member 4K of the photoconductive member unit 2K via mirrors 39 and 40.

Other than the differences in the toner color, the developing devices 5Y, 5M, 5C, and 5K have the same configuration, and the configuration of the developing device 5Y will be explained.

Figure 4:
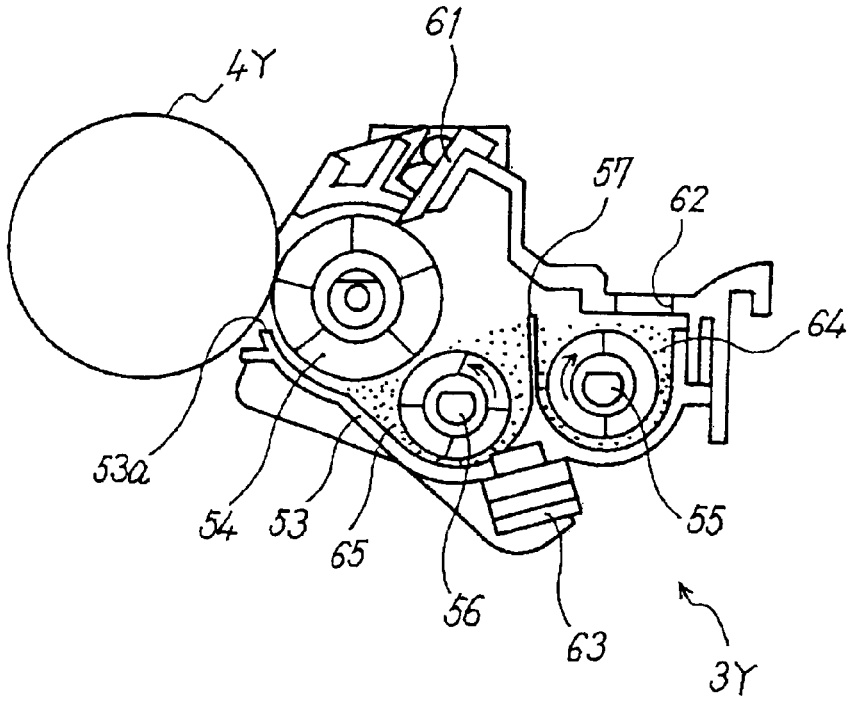
FIG. 4 is a diagram indicating the schematic configuration of the developing device of the same printer.

FIG. 4 is a diagram indicating the schematic configuration of the interior configuration of developing device 5Y. As indicated in FIG. 4, the developing device 5Y houses two-component developer having Y toner and carrier in a developer case 53 as the developer housing unit. Moreover, comprised inside the developer case 53 are a developing sleeve 54, which is a developer carrier member arranged to oppose the photoconductive member 4Y through an opening 53*a* of the developer case 53, and screw members 55 and 56 that transport developer while agitating.

An irregular roughness pattern with a maximum roughness height Rz of 20 to 40 [μm] and a mean roughness space Sm of 100 to 200 [μm] is formed on the surface of the developing sleeve in order to suppress a decrease in the amount of developer scooped up and to transport a stable amount of developer to the developing region. This irregular roughness pattern on the surface of the developing sleeve is formed by roughening processing such as sandblasting, electromagnetic blasting, or metal spraying. Sandblasting forms an irregular roughness pattern on the surface by blowing irregularly shaped particles such as such as Alundum or regularly shaped particles such as glass beads on the sleeve surface. In magnetic blasting, the sleeve is inserted into a housing tank that houses filamentous magnetic material with short filaments, and a rotating magnetic field is generated in the housing tank by an electromagnetic coil. Then, a rotating magnetic field causes the filamentous material housed in the housing tank to rotate around the outer circumference of the sleeve, and to impact the sleeve surface. An irregular roughness pattern is thereby formed on the sleeve surface.

Figure 6:
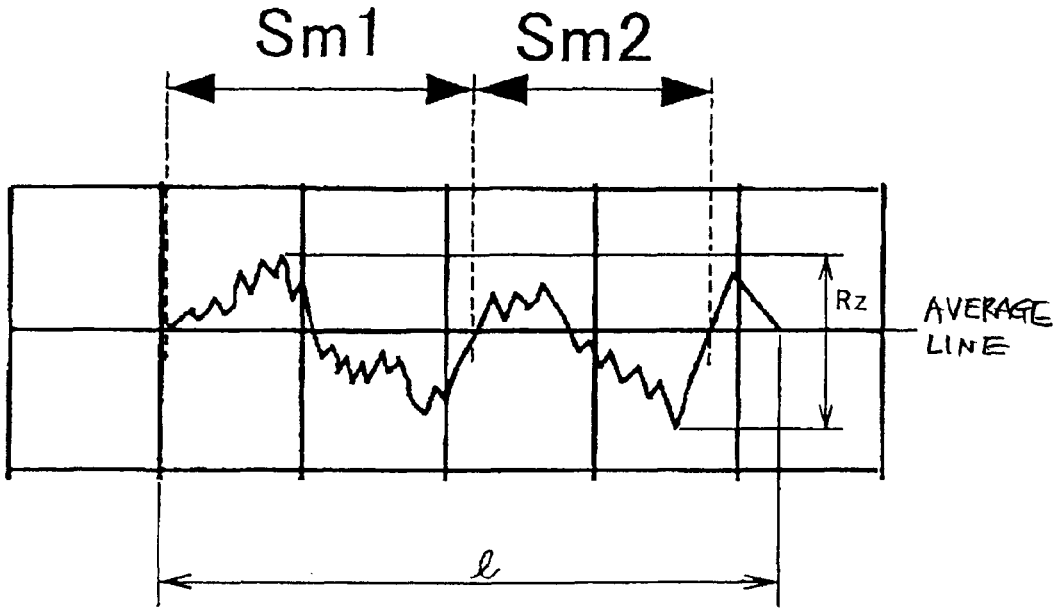
FIG. 6 is a diagram to explain the maximum roughness height Rz, and the mean roughness space Sm.

Further, as indicated in FIG. 6, the aforementioned roughness mean space Sm is drawn back to a standard length 1 from the curve, and is the mean length in the mean line direction of the Sm (outline curvature element) comprising one peak and one adjacent valley. Further, here, a peak is a part that displaces to the positive between the point of crossing the mean line to point of crossing the mean line again (upper side from the mean line). Moreover, a valley is the part that displaces to the negative side between the point of crossing the mean line to point of crossing the mean line again (lower side from the mean line).

The aforementioned developer case 53 is divided by a partition wall 57 into a first space part 65 that is positioned on the developer supply side to the photoconductive member 4Y, and a second space part 64 side that receives the supply of supplementary toner from the supply port 62. A screw member 56 and a screw member 55 are arranged in space regions 65 and 64 respectively, and are rotatably supported by a spindle receiving member not indicated in the diagram provided on the developer case 53. Of course, developing sleeve 54 is also rotatably supported on the developer case 53 via a spindle receiving member not indicated in the diagram, and rotates by rotation drive force transmitted from a drive means not indicated in the diagram. In addition, to detect the approach of the toner surface in space part 65, a toner concentration sensor 63 is mounted in the developer case 53 as a toner concentration detection means for detecting and outputs the toner concentration in the developer.

Figure 5:
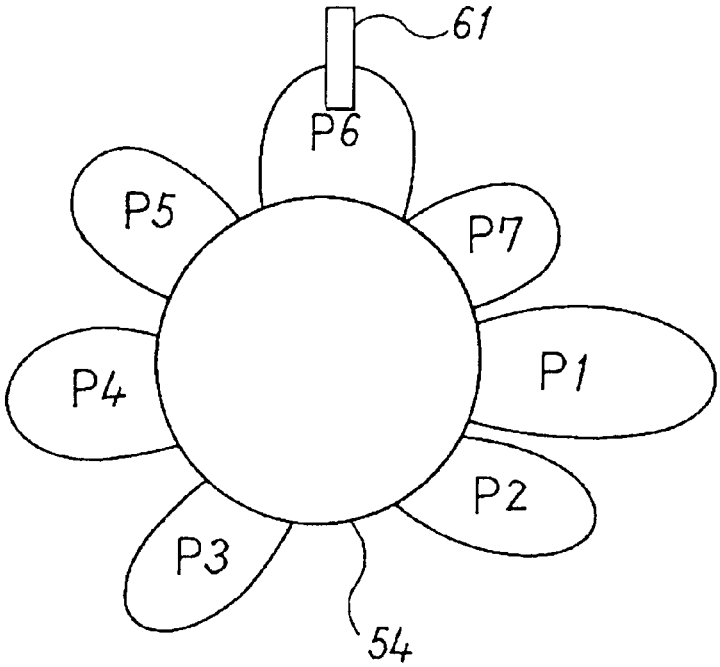
FIG. 5 is a diagram indicating one example of a magnetic field generated by a magnetic roller of the same developing device.

In the developing device 5Y with the aforementioned configuration, while circulating inside the developing device 5Y based on the constant velocity rotation of the screw members 55 and 56, the two-component developer within the developer case 53 is frictionally charged by the agitation of the Y toner and the carrier. Then, the transport screw 56 supplies part of the developer to the developing sleeve 54, and the developing sleeve 54 magnetically supports and transports that developer. To explain concretely, the carrier that the developer comprises spikes up into a chain shape on the developing sleeve 54 along the lines of magnetic force as indicated in FIG. 5 that are generated from a magnetic roller (not indicated in the diagram) that is arranged within the developing sleeve 54, and a magnetic brush is formed by the charged toner adhering to this carrier that has spiked up into a chain shape. The magnetic brush formed is transported in the same direction as the developing sleeve 54, specifically, counterclockwise, as the developing sleeve 54 rotates. Regarding the developer on the developing sleeve 54, the spike height (amount carried) of the developer chain spikes is restricted by a developer restricting member 61 arranged in a position opposing the magnetic force peaks in the normal direction of the surface of the developing sleeve 54. The electrostatic latent image on the photoconductive member 4Y is developed by the Y toner on the developing sleeve 54, and becomes the Y toner image. If the toner concentration of the developer within the developer case 53 becomes the specified value, Y toner is supplemented from a toner supplement port 62 to the space part 64 within the developer case 53. This Y toner is agitated by the screw member 55, mixed with developer, and is supplemented to the space part 65 side.

In the printer with the aforementioned configuration, when an operating unit not indicated in the drawing directs image formation, the photoconductive members 4Y, 4M, 4C, and 4K are rotated and driven by a drive source not indicated in the diagram and rotate clockwise in FIG. 1. The electrostatic rollers 16Y, 16M, 16C, and 16K of the photoconductive member units 2Y, 2M, 2C, and 2K apply an electrostatic bias from a power source not indicated in the diagram, and charge the photoconductive members 4Y, 4M, 4C, and 4K uniformly. After being uniformly charged by the electrostatic rollers 16Y, 16M, 16C, and 16K, the photoconductive members 4Y, 4M, 4C, and 4K are exposed to laser light modulated by Y, M, C, and K color image data by the writing apparatus 6, and electrostatic latent images are formed on the respective surfaces. These electrostatic latent images on the photoconductive members 4Y, 4M, 4C, and 4K are developed by the developing devices 5Y, 5M, 5C, and 5K to become Y, M, C, and K color toner images.

One sheet of transfer material P is separated by the paper supply rollers 45 and 46 from the paper supply cassette selected from the paper supply cassettes 13 and 14, and is supplied to a resist roller 51 arranged further to the paper supply side than the photoconductive member unit 2Y. In the present embodiment, the manual tray 15 is arranged on the right side region of the apparatus main unit 1, and the transfer material P can be supplied to resist roller 51 from this manual tray 15 as well. With the resist roller 51, the edge of the transfer material P is fed out onto the transfer belt 3 at a timing that coincides with the toner image on the photoconductive members 4Y, 4M, 4C, and 4K. The transfer material P that has been sent out is electrostatically adsorbed to the transfer belt 3 that has been charged by a paper adsorption roller 52, and is transported to the transfer units. When passing through the transfer units in order, the Y, M, C, and K color toner images on the photoconductive members 4Y, 4M, 4C, and 4K are overlapped and transferred by transfer brushes 47, 48, 49, and 50 to the transported transfer material P. A full color toner image of 4 overlapping colors is thereby formed. The full color toner image formed on the transfer material P is fixed by a fixing apparatus 9. After fixing, the transfer material P passes through the discharge route corresponding to the indicated mode, and is inverted and ejected the discharge paper tray 12, or advances directly from the fixing apparatus 9, passes inside an inversion unit 8, and is ejected straight.

The above imaging operations are operations that occur when the full color mode of 4 overlapping colors is selected by an operating unit not indicated in the diagram. For example, if a full color mode of 3 overlapping colors is selected by the operating unit, then the formation of the K toner image is omitted, and a full color image is formed on the transfer material P by overlapping the toner images of the 3 colors Y, M, and C. Moreover, if a black and white image formation mode is selected by the operating unit, then only the K toner image is formed, and a black and white image is formed on the transfer material P.

Next, the developing device 3, which is a characteristic point in the present embodiment, will be explained in detail.

A blast-finished developing sleeve is used as the developing sleeve 54 of the present embodiment. The decrease in the amount of developer carried by this blast-finished developing sleeve is mainly caused by a decrease of developer fluidity in association with degradation of the developer. Even if the fluidity of the developer has more or less declined, the type of developing sleeve that has grooves can compensate with high developer carrying capacity, and can thus address the decrease in the amount of developer carried. However, because the developer carrying capacity is low with the blast-finished developing sleeve 54, a decrease in fluidity leads to a reduction in the amount of developer carried. Further, a decrease in developer fluidity causes stress on the developer as it passes through the developer restricting member, and the agent that gives the toner fluidity is thereby buried, and the resin adhering to the surface of the carrier is scraped off.

Thus, in order to obtain high grade images while suppressing a decline in the amount of developer carried, at a minimum the developing device of the present embodiment comprises the following configuration.

1. The amount of developer carried per unit area on the developing sleeve is 30 [mg/cm$^2$] or more and 60 [mg/cm$^2$] or less.

2. The toner has a toner weight mean particle diameter is 4.5 [μm] or more and 8.0 [μm] or less, and the ratio [Dw/Dn] of the toner weight mean particle diameter (Dw) and the number mean particle diameter (Dn) is 1.20 or less.

3. The developing sleeve has an irregular roughness pattern on the surface, with a maximum surface roughness height Rz of 20 to 40 [μm], and with a roughness mean space Sm of 100 to 200 [μm].

4. The relationship between the developing gap PG and the gap DG between the developer restricting member and the developer carrier is $1.0 \leqq (DG/PG) \leqq 3.0$.

Figure 7:
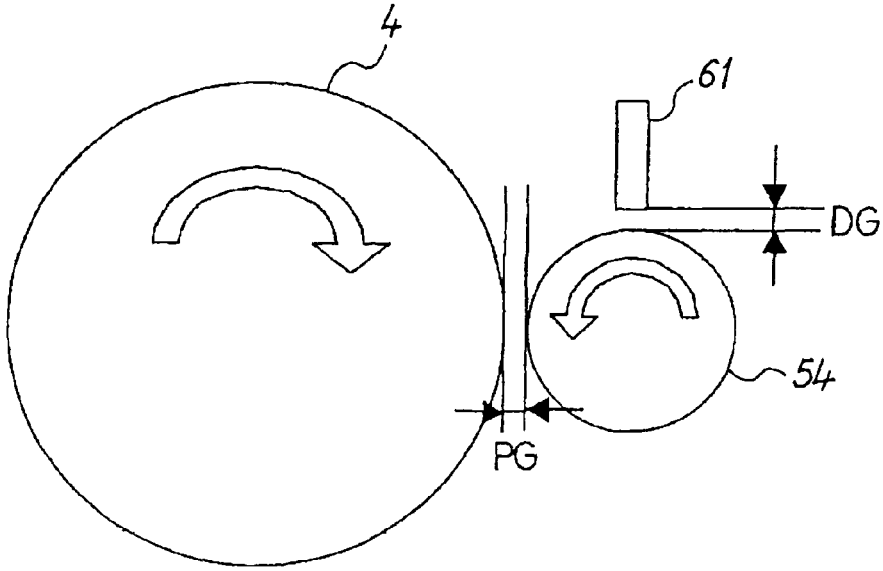
FIG. 7 is a diagram indicating the developing gap PG, and the gap DG between the developer restricting member and the developing sleeve.
Figure 8:
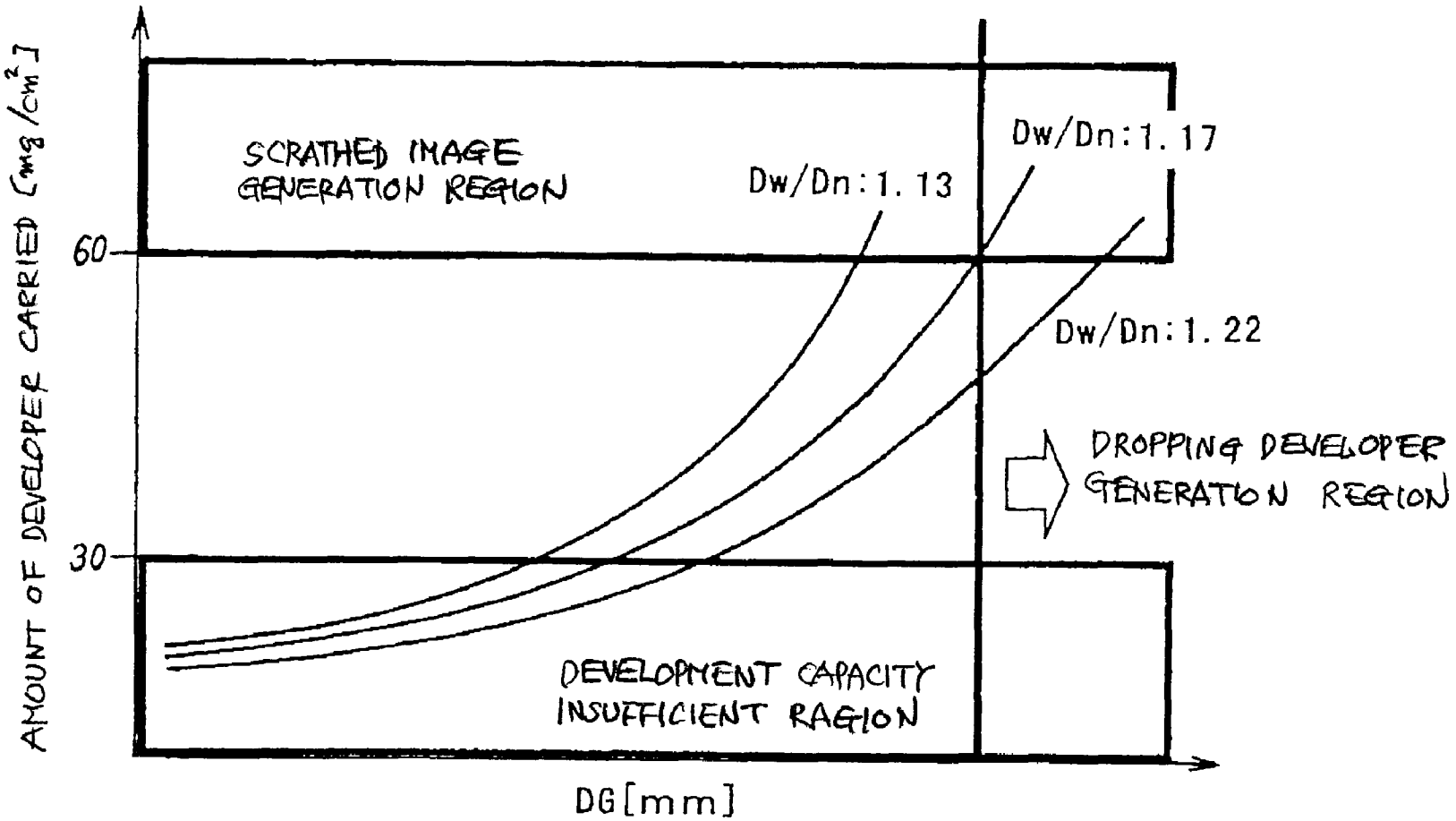
FIG. 8 is a diagram indicating the relationship between the amount of developer carried when the developing gap PG is 0.3 mm, the toner particle size distribution (Dw/Dn), and the gap DG between the developer restricting member and the developing sleeve.

A concrete explanation will be given below using FIGS. 7 and 8. Further, FIG. 8 indicates the relationship between the toner particle size distribution (Dw/Dn) when the developing gap PG is 0.3 mm, the amount of developer carried, and the gap DG between the developer restricting member 61 and the developing sleeve as indicated in FIG. 7.

In order to efficiently develop the image on the photoconductive member 4 with toner from the developing sleeve 54, it is necessary to adjust the amount of developer carried per unit area on the developing sleeve from 30 to 60 [mg/cm$^2$]. If the amount carried is less than 30 [mg/cm$^2$] as shown in FIG. 8, then the developing capacity will be insufficient. In order to guarantee developing capacity, the electric fields applied between the developing sleeve and the photoconductive member must be made greater. For that reason, carrier with weak magnetic characteristics is developed on the photoconductive member, and the problem of carrier adhesion becomes manifest. Moreover, the working life of the photoconductive member is shortened by increasing the amount of charge passing through. Further, if the amount carried is more than 60 [mg/cm$^2$], then scratching (scavenging phenomenon) of the toner developed on the photoconductive member by the magnetic brush is prone to occur, and as indicated in FIG. 8, can cause abnormal images with blanking of the halftone areas and scratching. Consequently, setting the amount of developer carried to the developing region to be less than 60 [mg/cm$^2$] acts beneficially to the reproducibility of fine lines and satisfactory image quality can be obtained.

To measure the amount of developer carried, after driving the developing device for 30 seconds, measurements are taken three times at three places in the front, center and back in the main scanning direction on the developing sleeve, and the mean values are calculated.

Moreover, preferably the toner weight mean particle diameter is to 4.5 to 8.0 [μm], and the ratio [Dw/Dn] of the toner weight mean particle diameter (Dw) and the number mean particle diameter (Dn) is adjusted to 1.20 or less. Making the toner particle size smaller in order to increase the resolution is unavoidable, but a side effect is that the fluidity and retention characteristic tend to worsen. With a toner particle diameter less than 4.5 μm, the fluidity of the developer deteriorates to the extreme, and it becomes difficult to guarantee uniform toner concentration in the developer. Moreover, decreasing toner particle diameter tends to raise the coating percentage in relation to the carrier, and if the coating percentage becomes too high, there is concern about accelerating carrier contamination and inducing toner scattering. Adding more additives to the toner as a means to improve fluidity of the toner and developer produces side effects, and cannot be expected to yield substantial improvement. However, the side effects associated with decreasing toner particle diameter can be overcome by making the particle diameter distribution of the toner uniform. Specifically, it is desirable for the ratio of the toner weight mean and number mean particle diameters Dw/Dn to be close to 1, and making this ratio 1.20 or less has the effect of suppressing deterioration of fluidity, and uniformity of toner concentration can be sought even when small particle diameter toner is used. In this way, in addition to image concentration stability, improvement of resolution may be sought and high image quality obtained by having a toner weight mean particle diameter of 4.5 to 8.0 μm and a toner weight mean and number mean particle diameter ratio Dw/Dn or 1.20 or less.

A smaller Dw/Dn value means a sharper particle size distribution. Making the Dw/Dn less than 1.20 can sharpen the toner particle diameter distribution, and in addition to improving the fluidity of the developer, can have the effect of increasing the developer bulk density. Moreover, even with decreased developer fluidity that is associated with deterioration of developing, compared to developers with a Dw/Dn of 1.20 or more, an effect is obtained to minimize the range of fluidity decrease when stress is added.

The toner particle size distribution may be measured by a variety of methods, but in this example a Coulter multisizer was used. Specifically, a Coulter multisizer model IIe (manufactured by Beckman Coulter) was used as the measuring instrument, and was connected to a personal computer and an interface (produced by Nikaki) that output the number distribution the weight distribution. A 1% NaCl aqueous solution using grade 1 sodium chloride was prepared as an electrolyte solution.

0.1 to 5 mL of a dispersing agent, preferably alkyl benzene sulfonate, was added to 100 to 150 mL of the aforementioned electrolyte aqueous solution, 2 to 20 mg of the measurement sample was added, and distribution processing was conducted for approximately 1 to 3 minutes with an ultrasound dispersing device. Further, 100 to 200 mL of electrolyte aqueous solution was placed in a separate beaker, the aforementioned sample dispersion solution was added therein to make the specified concentration, and the mean of 50,000 particles was measured by the aforementioned Coulter multisizer IIe using a 100 μm aperture as the aperture.

The number mean particle diameter Dn is obtained by multiplying the number by the mean particle diameter in each channel and taking the arithmetical average. The number mean particle diameter Dn in this case is expressed by the following equation.

$$Dn=\{\Sigma(nD)\}/\Sigma(n) \quad \text{Equation (1)}$$

Moreover, the weight mean particle diameter Dw is calculated based on the particle diameter distribution (relationship of the numeric frequency and the particle diameter) of the particles measured by numeric standards. The weight mean particle diameter Dw in this case is expressed by the following equation.

$$Dw=\{1/\Sigma(nD^3)\}\times\{\Sigma(nD^4)\} \quad \text{Equation (2)}$$

D in equation (1) and equation (2) indicates the mean particle diameter ([μm]) of particles present in each channel, and n indicates the total number of particles present in each channel. Further, a channel indicates the length for partitioning the particle diameter range into equal parts in a particle diameter distribution chart, and for this embodiment, a length of 2 [μm] was adopted. In addition, the lower limit value of the particle diameters maintained in each channel was adopted as the representative particle diameter of the particles present in each channel.

Moreover, as previous described, the blast type developing sleeve has lower developer carrying capacity compared to the type having grooves, but by satisfying the roughness maximum height Rz of 20 to 40 [μm] and Sm of 100 to 200 [μm] as the surface roughness of the developing sleeve, it is possible to guarantee developer carrying capacity. A stable amount of developer transport can thereby be guaranteed over time.

Moreover, if the developer carrying capacity is low, it is necessary to widen the DG in order to guarantee 30 to 60 [mg/cm$^2$] of developer per unit area in the developing region. If so, the layer thickness of developer to transport to the developing region becomes high, developer retention is generated, and developer drops off. Meanwhile, if the developer transport capacity is high, it is necessary to narrow the DG. When the DG is narrow, agglomerates of toner, large particles and foreign matter cannot pass through the developer restricting member, and clogging occurs at the developer restricting member. As a result, the amount of developer transported to the developing region may be reduced, and this may become a cause for abnormal images. Therefore there is a suitable range for the DG as well, and that suitable range is 0.3 to 0.8 [mm]. Consequently, in regard to the transport capacity of developing sleeve, the aforementioned roughness maximum height Rz and Sm are adjusted so that the DG fits within this range. Then, by satisfying a roughness maximum height Rz of 20 to 40 [μm] and a Sm of 100 to 200 [μm], the DG can be set to the range of 0.3 to 0.8 [mm], and the amount of developer transported to the developing region can be set to 30 to 60 [mg/cm$^2$].

In addition, it was demonstrated that if the relationship of DG/PG indicated in FIG. 7 is in the range of 1 to 3, dropping developer and adhesion to the developing sleeve can be overcome. When conducting evaluations using developers with differing bulk densities, irrespective of a greater or lesser amount of developer carried, if the DG exceeded the stipulated value, the phenomena of dropping developer and developing sleeve adhesion were observed. When investigating further, the contribution by DG/PG was demonstrated, and dropping developer was observed when the DG/PG exceeded 3. Moreover, if the DG/PG falls below 1, the amount of developer in the development nip region between the developing sleeve and the photoconductive member is excessively insufficient, and there is the concern that problems associated with a decline of developing capacity (excessive increase in toner concentration, white spots based on overabundant development potential) will occur. In addition, the margin for toner scattering also decreases.

The developing gap PG is preferably in the range of 0.25 to 0.35 mm. If the developing gap PG exceeds 0.35 [mm], the developing gap PG is too wide, the developing electric field is not delivered from the developing sleeve 54 to the photoconductive member 4, and the electric field reverting to the surface of the developing sleeve is prone to occur. Then, the toner does not adhere uniformly to the imaging unit, and in particular, irregularities appear in halftone images and graininess worsens. In addition, if the developing gap PG is too small, there are the concerns that with minute fluctuations of the gap the developing sleeve 54 and the photoconductive member 4 will make contact with developer in between, that the toner caught in between will become packed, and that toner will adhere to the developing sleeve 54. Consequently, the lower limit of the developing gap was set at 0.25 [mm].

Only direct current (DC) bias is applied as the developing bias, and alternating current (AC) is not applied. In a system that applies superimposed bias in which AC bias is superimposed on DC bias as the developing bias, momentarily high voltage is applied by the AC bias. Leaks are thereby generated between the photoconductive member 4 and the developing sleeve 54, and the latent image on the photoconductive member is disturbed, with the result that so-called blurry images may appear. Consequently, in the present invention, blurry images are suppressed and high grade images are realized by applying only direct current (DC) bias as the developing bias.

Next, an explanation will be given of the magnetic particle carrier that can be suitably utilized in the developing device of the present embodiment.

The carrier utilized in the developing device of the present embodiment comprises core material particles having magnetic characteristics and non-magnetic bonding resin that coats the surface thereof. A variety of particles may then be added to this bonding resin with the object of adjusting the electric charge characteristics, etc, but in the carrier of the present embodiment, it is preferable to add aluminum oxide. By adding aluminum oxide, an effect to suppress the advance of carrier surface membrane abrasion is obtained, and it is possible to suppress the rapid decrease in carrier resistance.

Moreover, it is preferable to use a small particle diameter carrier with a weight mean particle diameter of 20 [μm] or more and 45 [μm] or less. Using a carrier with a weight mean particle diameter of 20 to 45 [μm] has the following advantages: (1) A sufficient frictional electric charge can be imparted to the individual toner particles because of the wide surface area per unit of weight, and little low charge toner and reverse charge toner is produced. As a result, an effect to suppress the generation of scum is obtained. (2) The toner mean charge can be made low because of the wide surface area and resistance to generating scum, and sufficient image concentration is obtained. Consequently, small particle diameter carrier can compensate for the disadvantages when using small diameter toner, and is effective in drawing out the advantages of small particle diameter toner. (3) Small particle diameter carrier forms a dense magnetic brush, and has satisfactory spike fluidity. For this reason, generating a post-spike image is characteristically difficult. However, when making a small particle diameter carrier, the magnetic moment per carrier particle decreases, the magnetic carrier retention capacity on the developing sleeve decreases, carrier adhesion is prone to occur, and these circumstances can cause damage to the photoconductive member and damage to the fixing roller.

An effect to improve on this kind of carrier adhesion can be obtained by using a carrier in which the volume resistivity value is 12 [Log (Ω·cm)] or more and 16 [Log (Ω·cm)] or less. With a volume resistivity value exceeding 16 [Log (Ω·cm)] the edge effect deteriorates to an impermissible level, and is not preferable. Further, if falling below the lower limit measurable by a high resistance meter, the volume resistivity value cannot be quantitatively obtained, and is handled as a break down value. The volume resistivity in the present Description is a value wherein, after introducing the carrier between the parallel electrodes set at a gap of 2 mm, DC 1000 V is applied between both electrodes, and after 30 seconds, the resistance value is measured with a high resistance meter.

Figure 9:
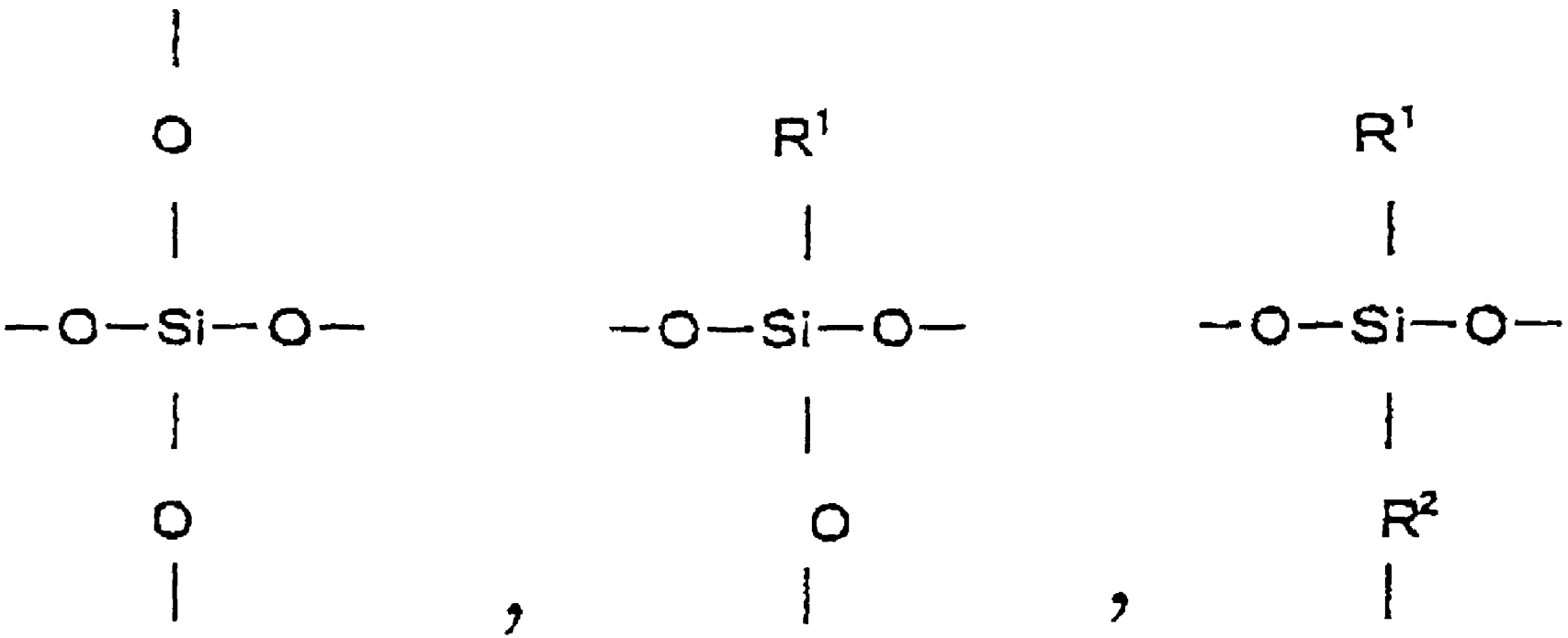
FIG. 9 is a diagram indicating the chemical formula of silicone resin for forming a bonding resin layer of the developer carrier used.

The carrier comprises core particles having magnetic characteristics and a non-magnetic bonding resin coated on the surface thereof. Well-known resins used in the manufacturing of conventional carriers may be used as the resin for forming this bonding resin layer, which is the coating layer. Preferably, for example, silicone resin comprising repeated units expressed by the chemical formula indicated in FIG. 9 may be used. In the formula, R1 indicates a hydrogen atom, halogen atom, hydroxyl group, a low grade alkyl group with 1 to 4 carbon atoms, or an aryl group (phenyl group, tolyl group, and the like). R2 indicates an alkylene group with 1 to 4 carbon atoms, or an arylene group (phenylene group, and the like).

KR271, KR272, KR282, KR252, KR255, and KR152 (manufactured by Shin-Etsu Chemical Co.) and SR2400 and SR2406 (manufactured by Toray Dow Corning Silicone Co.) can be cited as example of straight silicone resin used in the bonding resin layer describe above. Altered silicon resin may also be used as the resin layer. Epoxy altered silicone, acryl altered silicone, phenol altered silicone, urethane altered silicone, polyester altered silicone, alkyd altered silicone and the like may be cited as such substances. Of these, epoxy altered substance: ES-1001N, acryl altered silicone: KR-5208, polyester altered silicone: KR-5203, alkyd altered substance: KR-206, urethane altered substance: KR-305 (the above manufactured by Shin-Etsu Chemical Co.) and epoxy altered substance: SR2115, and alkyd altered substance: SR2110 (manufactured by Toray Dow Corning Silicone Co.) may be cited as concrete examples of altered silicone resin.

A suitable amount (0.001 to 30 weight %) of amino silane coupling agent may be contained in the silicone resin described above, and the following may be cited as examples.

$H_2N(CH_2)_3Si(OCH_3)_3$: MW179.3

$H_2N(CH_2)_3Si(OC_2H_5)_3$: MW221.4

$H_2NCH_2CH_2CH_2Si(CH_3)_2(OC_2H_5)$: MW161.3

$H_2NCH_2CH_2CH_2Si(CH_3)(OC_2H_5)_2$: MW191.3

$H_2NCH_2CH_2NHCH_2Si(OCH_3)_3$: MW194.3

$H_2NCH_2CH_2NHCH_2CH_2CH_2Si(CH_3)(OCH_3)_2$: MW206.4

$H_2NCH_2CH_2NHCH_2CH_2CH_2Si(OCH_3)_3$: MW224.4

$(CH_3)_2NCH_2CH_2CH_2Si(CH_3)(OC_2H_5)_2$: MW219.4

$(C_4H_9)_2NC_3H_6Si(OCH_3)_3$: MW291.6

The following substances may be used singly in the bonding resin layer described above, or may be mixed and used with the silicone resins described above. Specifically, styrene resins such as polystyrene, chloropolystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleate copolymer, styrene-acrylate ester copolymer (styrene-methyl acrylate copolymer, styrene-ethyl acrylate copolymer, styrene-butyl acrylate copolymer, styrene-octyl acrylate copolymer, styrene-phenyl acrylate copolymer, and the like), styrene-methacrylate ester copolymer (styrene-methyl methacrylate copolymer, styrene-ethyl methacrylate copolymer, styrene-butyl methacrylate copolymer, styrene-phenyl methacrylate copolymer, and the like), styrene-α-methyl chloracrylate copolymer, styrene-acrylonitrile-acrylic ester copolymer and the like; epoxy resin, polyester resin, polyethylene resin, polypropylene resin, ionomer resin, polyurethane resin, ketone resin, ethylene-ethylacrylate copolymer, xylene resin, polyamide resin, phenol resin, polycarbonate resin, meramine resin and the like may be cited.

Well-known methods such as spray drying, immersion, or powder coating may be used as the method to form the bonding resin layer on the surface of the core particles of the magnetic carrier. In particular, the method that used a fluid bed type coating apparatus is effective in forming a uniform coated membrane.

The thickness of the bonding resin layer formed on the surface of the carrier core particles is normally 0.02 to 1 [μm], preferably 0.03 to 0.8 [μm]. Because the thickness of the resin layer is extremely small, the particle size distribution of the carrier comprising the core particles coated with the resin layer and that of the carrier core particles are substantially the same.

It is desirable to adjust the electric resistance ratio of the magnetic carrier as necessary. Adjustment of the resistance of the resin coated on the core particles, and adjustment by controlling the film thickness are possible. A conductive micro-powder added to the coated resin layer may be used to adjust the resistance. Metal or metal oxide powders of conductive ZnO, Al and the like, $SnO_2$ adjusted by a variety of methods or $SnO_2$ doped with various types of elements, borides such as $TiB_2$, $ZnB_2$, and $MOB_2$, silicon carbide, conductive polymers such as polyacetylene, polyparaphenylene, poly(para-phenylene sulfide) polypyrrole, and polyethylene, and carbon blacks such as furnace black, acetylene black and channel black may be cited as the aforementioned conductive micro-powder. After introducing into a solvent to be used in coating or a resin solution for coating, these conductive powders can be uniformly dispersed by dispersing equipment that uses a medium such as a bowl mill, or bead mill, or by an agitator comprising a blade that rotates at high speed.

The toner that can be suitably used in the developing device of the present embodiment will be explained next.

As described above, toner that can be suitably used in the developing device of the present embodiment has a toner weight mean particle diameter of 4.5 to 8.0 [μm], and has a particle diameter distribution with a ratio (Dw/Dn) of the weight mean particle diameter (Dw) to number mean particle diameter (Dn) of 1.20 or less. Resolution can be improved by adding image concentration stability, and high quality images can be obtained. Further, making the percentage of particles 3 μm or less be 5% or less in the toner particle size distribution provides a notable effect to improve the quality of fluidity and retention; and a satisfactory level can be obtained for supplementing toner into the developing device and for toner charge startup.

Preferably, toner with an average circularity of 0.95 or more is used. Using this kind of toner makes high level dot reproducibility possible that can keep up with the high image resolutions of recent years.

It is possible to measure average circularity using a flow particle image analyzer FPIA-2000 (commercial name, manufactured by Toa Medical Electronics Co., Ltd.). Concretely, 0.1 to 0.5 [mL] of surfactant, preferably alkyl benzene sulfonate salts, is added as a dispersing agent to a container with 100 to 150 [mL] of water with solid impurities removed in advance, and about 0.1 to 0.5 [g] of the sample to be measured (toner) is added. Afterwards, the this suspension solution with dispersed toner is processed by an ultrasound dispersing device for approximately 1 to 3 minutes, and a sample wherein the concentration of the dispersion solution is 3000 to 10,000 [particles/μL] is set up in the aforementioned analyzer, and the toner shape and distribution are measured. Then, based on these measurement results, the mean value is calculated for the values of the individual particle images derived by dividing the circumference of the equivalent circle equal to the photographic area by the circumference of the actual particle. This mean value is the average circularity.

The toner comprises, at a minimum, bonding resin, colorant, releasing agent and charge control agent. This toner can be irregular shaped or spherical toner produced by various types of toner manufacturing methods such as polymerization or granulation. In addition, either magnetic or non-magnetic toner may be used.

Substances conventionally used as toner bonding resin may be employed as the bonding resin contained in the toner. Specifically, styrene and monomers of the substituents thereof such as polystyrene, polychlorostyrene, and polyvinyl toluene; styrene copolymers such as styrene/p-chlorostyrene copolymer, styrene/propylene copolymer, styrene/vinyl toluene copolymer, styrene/vinyl naphthalene copolymer, styrene/methyl acrylate copolymer, styrene/ethyl acrylate copolymer, styrene/butyl acrylate copolymer, styrene/octyl acrylate copolymer, styrene/methyl methacrylate copolymer, styrene/ethyl methacrylate copolymer, styrene/butyl methacrylate copolymer, styrene/α-methyl chloracrylate copolymer, styrene/acrylonitryl copolymer, styrene/ethyl vinyl ether copolymer, styrene/methyl vinyl ketone copolymer, styrene/butadiene copolymer, styrene/isoprene copolymer, styrene/acrylonitryl/indene copolymer, styrene/maleate copolymer, and styrene/maleate ester copolymer; polymethyl methacrylate, polybutyl methacrylate, polyvinyl chloride, polyvinyl acetate, polyethylene, polypropylene, polyester, polyvinyl butyl butyral, polyacrylate resin, rosin, denatured rosin, terpene resin, phenol resin, aliphatic or alicyclic hydrogen carbide resin, aromatic oil resins, paraffin chloride, paraffin wax, and the like. These may be used singly or in mixtures of two or more kinds.

Pigments and dyes that are used in conventional toner colorants and that are capable of obtaining the colors of yellow, magenta, cyan and black may be used as the colorants contained in the toner. Concretely, nigrocine dye, aniline blue, carcoyl blue, Dupont oil red, quinoline yellow, methylene blue-chloride, phthalocyanine blue, hansa yellow-G, rhodamine 6C lake, chrome yellow, quinacrydone, benzizine yellow, malachite green, malachite greenhexylate, rose Bengal, monoazo dyes and pigments, disazo dyes and pigments, trisazo dyes and pigments, and the like may be used. The amount of these colorants used is normally 1 to 30 wt % in relation to the bonding resin, preferably 3 to 20 wt %.

Any positive charge control agent or negative charge control agent is usable as the charge control agent contained in the toner, but with color toner, preferably a transparent or white substance that does not alter the coloration is used. For example, grade 4 ammonium salts, imidazole metal complexes and salts may be cited as examples for positive electrodes. Moreover, salicylate complexes and salts, organic boron salts, and calixarene compounds and the like may be cited as examples for negative electrodes.

In addition to synthetic waxes such as low molecular weight polyethylene, and polypropylene, vegetable waxes such as candelilla wax, carnauba wax, rice wax, tree wax and jojoba oil; animal waxes such as beeswax, lanolin, and whale wax; mineral waxes such as montan wax, and ozokerite; and fats and oils based waxes such as hardened castor oil, hyroxystearate, fatty acid amides, and phenol fatty acid ester may be contained in the tone for the purpose of manifesting superior die release characteristics. These die release promoters may be used singly or in mixtures of two or more kinds.

Moreover, in addition to the die release promoters described above, auxiliary agents such as various types of plasticizers (dibutyl phthalate, dioctyl phthalate, and the like), and resistance adjusters (tin oxide, lead oxide, antimony oxide, and the like) may be added to the toner for the purpose of adjusting the thermal characteristics, electrical characteristics, or physical characteristics as necessary.

In addition, fluidizers other than the die release promoters and auxiliary agents described above may be added to the toner as necessary. Silica microparticles, titanium oxide microparticles, aluminum oxide microparticles, magnesium fluoride microparticles, silicon carbide microparticles, boron carbide microparticles, titanium carbide microparticles, zirconium carbide microparticles, boron nitride microparticles, titanium nitride microparticles, zirconium nitride microparticles, magnetite microparticles, molybdenum disulfide microparticles, aluminum stearate microparticles, magnesium stearate microparticles, zinc stearate microparticles, fluorine rein microparticles, and acryl resin microparticles may be cited as examples of fluidizers. These die release promoters may be used singly or in mixtures of two or more kinds. Preferably, the diameters of the primary particles of the fluidizer are smaller than 0.1 μm; the surface undergoes hydrophobic treatment with silane coupling agent, silicone oil, or the like; and the degree of hydrophobization is 40 or more.

Specifically, preferably hydrophobic silica microparticles and hydrophobic titanium microparticles are used together as fluidizers added to the toner. In particular, substances with mean particle diameters of 50 [nm] or less are preferable for both microparticles. By using substances with mean particle diameters of 50 [nm] or less for both microparticles, once agitated and mixed, the electrostatic capacity and the van der Waals capacity with the toner are dramatically improved. Even by agitating and mixing inside the developer, which is conducted in order to obtain the specified charge level, the fluidizers are not detached from the toner, and excellent image quality can thereby be obtained. Moreover, a reduction in toner remaining after transfer may be anticipated.

Further, titanium oxide particles are superior in environmental stability and image concentration stability. However, the charge startup characteristics tend to deteriorate. Because of this, if the amount of titanium oxide microparticles added is greater than the amount of silica microparticles added, the side effects described above appear to become greater. However, it has been demonstrated that there is no great loss of charge startup characteristics with the amount of hydrophobic silica microparticles added in the range of 0.3 to 1.5 [wt %] and the amount of hydrophobic titanium oxide microparticles added in the range of 0.2 to 1.2 [wt %]. A stable image quality can thereby be obtained even with repeated copying, and an effect to control toner scattering can also be obtained.

Hydrophobic silica microparticles with a mean particle diameter of 80 to 140 [nm] may further be added as a fluidizer. An effect to reduce the adhesive force between toner particles can be obtained by adding hydrophobic silica microparticles. Not only is transferability thereby improved, but controlling locally generated transfer irregularities, which are prone to occur when outputting low surface area images, is also possible. Consequently, the effect to improve the quality of the image is notable, and excellent image quality can be obtained over a long period of time.

Toner manufactured by a variety of conventional, well-known methods can be used. The following manufacturing methods provide examples. Specifically, bonding resin, colorant and pigment, charge control agent, and releasing agent and the like as necessary are thoroughly mixed in the suitable proportions using a mixing machine such as a Henschel mixer or bowl mixer. Afterwards, fusion kneading is conducted using a screw extrusion continuous mixing kneader, a two-roll mill, a three-roll mill, or a pressure and heat mill. With color toner, a master batch pigment, which is obtained by pre-fusing and kneading the pigment and a part of the bonding resin, is generally used as the colorant in order to improve the pigment dispersion characteristics. After kneaded substance obtained in this way is cooled and solidified, rough pulverizing is conducted using a pulverizer such as a hammer mill. After further pulverizing with a jet mill pulverizer, the surface is treated using a rotor pulverizer and the like connected to an airflow type pulverizer and the like. Hammer mills, bowl mills, tube mills, vibrating mills and the like may be cites as examples of impact pulverizers. I-type or IDS-type impact pulverizers (manufactured by Japan Pneumatic Manufacturing Co.) are preferably used as a jet pulverizer that has compressed air and an impact plate equipped as main components. Moreover, a roll mill, pin mill, fluid layer jet mill and the like may be cited as examples of a rotor pulverizer. Specifically, Turbo Mill (manufactured by Turbo Industries), Clyptron (manufactured by Kawasaki Heavy Industries), or Fine Mill (manufactured by Japan Pneumatic Industries) may be used as a rotor pulverizer equipped with main components of a fixed container as an external wall and a rotating piece having the same central axis as this fixed container. Regarding connected classifiers, a dispersion separator (DS) classifier (manufactured by Japan Pneumatic Industries) or a multi-partitioned classifier (Elbow Jet; manufactured by Nittetsu Mining Co.) may be used as airflow type classifiers. Further, fine powder classification may be conducted using an airflow classifier or a mechanical classifier to obtain microparticles.

Well-known equipment such as a Henschel mixer, super mixer, or bowl mill, and the like may be used when adding and mixing fluidizers to the microparticles obtained by the related methods. The method of directly manufacturing toner from monomers, colorants and fluidizers by suspension polymerization or non-aqueous dispersion polymerization may also be used.

Next, the developing device of the present embodiment will be explained in further detail using examples 1 to 13 and comparative examples 1 to 7.

First, the examples and comparative examples will be explained. The characteristics of carriers 1 to 5 used in the examples and comparative examples are indicated in FIG. 10, and the main characteristics of the examples and comparative examples are indicated in FIG. 11.

EXAMPLE 1

Toner Manufacturing Example (Master Batch Pigment Component)

| | | |
|---|---|---|
| Pigment | Quinacridone magenta pigment (C.I. pigment red 122) | 50 weight parts |
| Bonding resin | Epoxy resin | 50 weight parts |
| Water | | 30 weight parts |

The above raw materials were mixed in a Henschel mixer, and a mixture of pigment aggregate permeated with water was obtained. This mixture was kneaded for 45 minutes in a two-roll mill with the roller surface temperature set to 130° C., and master batch pigment (1) was obtained. Next, toner was prepared by the following method using this master batch pigment (1).

(Toner Component)

| | | |
|---|---|---|
| Bonding resin | Epoxy resin (R-304, Mitsui Chemical) | 100 weight parts |
| Colorant | Master batch pigment (1) | 13 weight parts |
| Charge control agent | Zinc salicylate salt (Bontron E84, Orient Chemicals) | 2 weight parts |

The mixture of the related composition was fused and kneaded with a two spindle kneader, and the kneaded mixture was crushed into microparticles with a mean particle diameter of 7.3 [μm] in a jet mill pulverizer equipped with a flat impact plate in the crushing region, and surface treatment was further conducted using a turbo mill connected to a DS type airflow classifier, but the mean particle diameter was 7 [μm]. With further microparticle classification, microparticles with a weight mean particle diameter of 7.5 [μm], a number percentage of particles 3 [μm] or less of 8 [%], and an average circularity of 0.937 were obtained. One hundred grams of hydrophobic silica microparticles with a mean particle diameter of 30 [nm], and 50 g of hydrophobic titanium oxide microparticles with a mean particle diameter of 30 [nm] were added to 20 kg of the microparticles, and this mixture was agitated and mixed to obtain magenta electronic photography toner (Dw/Dn: 1.20).

Example of Manufacturing Carrier 1

[Carrier Coating Layer]

| | | |
|---|---|---|
| Silicon resin solution | [Solid content 23 weight % (SR2410: manufactured by Toray Dow Corning Silicone)] | 132.2 weight parts |
| Amino silane | [Solid content 100 weight % (SH6020: manufactured by Toray Dow Corning Silicone)] | 0.66 weight parts |
| Inorganic oxide microparticles A | Aluminum oxide, particle diameter: 0.40 [μm], absolute specific gravity: 3.9, particle powder specific resistance: $10^{12}$ Ω · cm] | 145 weight parts |
| Toluene | | 300 weight parts |

The above components were dispersed for 10 minutes in a homogenizing mixer, and a silicon resin coating film formation solution was obtained. A super coater (Okada Seiko Co., Ltd.) at an internal temperature of 40° C. was used to coat and dry the aforementioned coating film formation solution onto 5000 weight parts of a sintered ferrite powder (absolute specific gravity: 5.5) having a mean particle diameter of 35 [μm] as the core material so that the film thickness on the core material was 0.15 [μm]. The carrier obtained was left to stand for 1 hour and then sintered at 240° C. in an electric furnace. After cooling, the bulk ferrite powder was broken up using a mesh 63 [μm] sieve, and [carrier 1] with a volume specific resistance of 15.9 [Log (Ω·cm)], and a magnetization of 68 $Am^2/kg$ was obtained.

Next, using the color toner and carrier 1 obtained by the methods above, a developer with a toner concentration (TC) of 5 [wt %] was prepared, and evaluations were conducted in actual equipment using an IPSiO Color Model 8100 printer manufactured by Ricoh (blast type developing sleeve with a surface roughness Rz: 30 [μm], Sm: 150 [μm], DG: 0.6 [mm], amount of developer carried mean value: 35 [$mg/cm^2$], PG: 0.3 [mm]). The paper passage conditions were: image area percentage: 5%, duty: 100K sheets at 1 P/J. Further, the aforementioned amount of developer carried was the average value from measuring the 3 locations of front, center and back in the main scan direction 3 times.

EXAMPLE 2

Microparticle classification was conducted using powder passing through the surface processing steps in Example 1 above to obtain microparticles with a weight mean particle diameter of 7.7 [μm], a number percentage of particles 3 [μm] or less of 4%, and an average circularity of 0.941. One hundred grams of hydrophobic silica microparticles with a mean particle diameter of 0.3 [μm], and 50 g of hydrophobic titanium oxide microparticles with a mean particle diameter of 0.3 [μm] were added to 20 kg of the microparticles, and were agitated and mixed to obtain magenta electronic photography toner (Dw/Dn: 1.15). The same carrier as in Example 1 was used, and evaluations were conducted under the same conditions as in Example 1 (amount of developer carried mean value 40 [$mg/cm^2$]).

EXAMPLE 3

Example of Manufacturing Polymer Toner

After 450 g of 0.1M $Na_3PO_4$ aqueous solution was introduced into 710 g of ion exchanged water and heated to 60° C., this was agitated at 12000 rpm using a TK homogenizing mixer (manufactured by Tokushuki Kakogyo). To this, 68 g of 1.0M $CaCl_2$ aqueous solution was gradually added to obtain a water-based medium containing $Ca_3(PO_4)_2$.

(Toner Component)

| | |
|---|---|
| Styrene | 170 g |
| n-Butyl acrylate | 30 g |
| Quinacridone magenta pigment | 10 g |
| Di-t-butyl salicylate metal compound | 2 g |
| Polyester resin | 10 g |

The above formulation was heated to 60° C., and uniformly dissolved and dispersed at 12000 rpm using a TK homogenizing mixer (manufactured by Tokushuki Kakogyo). Ten grams of polymerization initiator 2,2'-azobis(2,4-dimethylvaleronitryl) was dissolved in this and the polymerizable monomer composition was adjusted. The aforementioned polymerizable monomer composition was introduced into the aforementioned water-based medium and was agitated for 20 minutes at 10000 rpm in a TK homogenizing mixer at 60° C. in an $N_2$ atmosphere, and the polymerizable monomer composition was made into particles. Afterwards, while agitating with a paddle agitator blade, the temperature was increased to 80° C., and this composition was allowed to react for 10 hours. After the polymerization reaction was complete, the water-based medium part was removed under reduced pressure and the reactant was cooled; and after dissolving the calcium phosphate by adding hydrochloric acid, this was filtered, rinsed and dried, and color suspension particles with a weight mean particle diameter of 6.2 μm, a percentage of particles 3 μm or less or 2%, and an average circularity of 0.954 were obtained. One hundred grams of hydrophobic silica microparticles with a mean particle diameter of 30 [nm], and 100 g of hydrophobic titanium oxide microparticles with a mean particle diameter of 30 [nm] were added to 20 kg of the microparticles, and were agitated and mixed to obtain magenta electronic photography toner (Dw/Dn: 1.12). The same carrier 1 as in Example 1 was used, and evaluations were conducted under the same conditions as in Example 1 (amount of developer carried mean value 45 [mg/cm$^2$]).

EXAMPLE 4

Using the toner of Example 3 above and the carrier of Example 1, a developer with a toner concentration (TC) of 5 m[wt %] was prepared, and evaluations were conducted in actual equipment using an IPSIO Color Model 8100 printer manufactured by Ricoh (blast type developing sleeve with a surface roughness Rz: 40 [μm], Sm: 150 [μm], DG: 0.3 [mm], amount of developer carried mean value: 30 [mg/cm$^2$], PG: 0.3 [mm]). The paper passage conditions were: image area percentage: 5%, duty: 100K sheets at 1 P/J.

EXAMPLE 5

Using the toner of Example 3 above and the carrier of Example 1, a developer with a toner concentration (TC) of 5 [wt %] was prepared, and evaluations were conducted in actual equipment using an IPSiO Color Model 8100 printer manufactured by Ricoh (blast type developing sleeve with a surface roughness Rz: 20 [μm], Sm: 150 [μm], DG: 0.9 [mm], amount of developer carried mean value: 50 [mg/cm$^2$], PG: 0.3 [mm]). The paper passage conditions were: image area percentage: 5%, duty: 100K sheets at 1 P/J.

EXAMPLE 6

Using the toner of Example 3 above and the carrier of Example 1, a developer with a toner concentration (TC) of 5 [wt %] was prepared, and evaluations were conducted in actual equipment using an IPSiO Color Model 8100 printer manufactured by Ricoh (blast type developing sleeve with a surface roughness Rz: 20 [μm], Sm: 130 [μm], DG: 0.9 [mm], amount of developer carried mean value: 60 [mg/cm$^2$], PG: 0.3 [mm]). The paper passage conditions were: image area percentage: 5%, duty: 100K sheets at 1 P/J.

EXAMPLE 7

Example of Manufacturing Carrier 2

The coating layer formulation is indicated below. Other than modifying to a mixed group of acrylic resin group and silicon resin group, this example is the same and Example 1, and [carrier 2] with a volume specific resistance of 14.5 [Log (Ω·cm)], and a magnetization of 68 Am$^2$/kg was obtained.

| | | |
|---|---|---|
| Acrylic resin solution | (Solid content 50 weight %) | 19.9 weight parts |
| Guanamine solution | (Solid content 70 weight %) | 6.2 weight parts |
| Acidic catalyst | (Solid content 40 weight %) | 0.11 weight parts |
| Silicon resin solution | [Solid content 20 weight % (SR2410: manufactured by Toray Dow Corning Silicone)] | 92.9 weight parts |
| Amino silane | [Solid content 100 weight % (SH6020: manufactured by Toray Dow Corning Silicone)] | 0.21 weight parts |
| Inorganic oxide microparticles B | Aluminum oxide, particle diameter: 0.37 μm, absolute specific gravity: 3.9, particle powder specific resistance: $10^{13}$ Ω · cm] | 97 weight parts |
| Toluene | | 400 weight parts |

Other than modifying the carrier of the toner used in the aforementioned Example 3 to [carrier 2], evaluations were conducted under the same conditions as in Example 1.

EXAMPLE 8

Example of Manufacturing Carrier 3

Other than using conductive particles A [particle powder specific resistance: $10^8$ (Ω·cm)] instead of inorganic micropowder, [carrier 3] with a volume specific resistance of 11.2 [Log (Ω·cm)] was obtained in the same way as in Example 7. The conductive particles and conductive microparticles contained in the resin coating layer at this time had a coating percentage of 83% in relation to the core material.

Other than modifying the carrier used in Example 7 above to [carrier 3], evaluations were conducted under the same conditions as in Example 1.

EXAMPLE 9

Example of Manufacturing Carrier 4

Other than modifying the carrier weight mean particle diameter to 18 [μm] (absolute specific gravity: 5.7), and the amount of microparticles added, [carrier 4] with a volume specific resistance of 15.7 [Log (Ω·cm)] and magnetization of 66 Am$^2$/kg was obtained in the same way as in Example 1.

| | | |
|---|---|---|
| Acrylic resin solution | (Solid content 50 weight %) | 43.7 weight parts |
| Guanamine solution | (Solid content 70 weight %) | 13.6 weight parts |
| Acidic catalyst | (Solid content 40 weight %) | 0.24 weight parts |
| Silicon resin solution | [Solid content 20 weight % (SR2410: manufactured by Toray Dow Corning Silicone)] | 204.4 weight parts |
| Amino silane | [Solid content 100 weight % (SH6020: manufactured by Toray Dow Corning Silicone)] | 0.46 weight parts |
| Inorganic oxide microparticles B | Aluminum oxide, particle diameter: 0.37 μm, absolute specific gravity: 3.9, particle powder specific resistance: $10^{13}$ Ω · cm] | 195 weight parts |
| Toluene | | 800 weight parts |

Other than modifying the carrier 1 used in Example 3 above to carrier 4, evaluations were conducted with the same toner as in Example 3, and under the same conditions (amount of developer carried mean value 58 [mg/cm$^2$]) as in Example 3.

EXAMPLE 10

Example of Manufacturing Carrier 5

Other than modifying the carrier weight mean particle diameter to 71 [μm] (absolute specific gravity: 5.3), and the amount of microparticles added, [carrier 5] with a volume specific resistance of 14.5 [Log (Ω·cm)] and magnetization of 69 Am$^2$/kg was obtained in the same way as in Example 1.

| | | |
|---|---|---|
| Acrylic resin solution | (Solid content 50 weight %) | 39.7 weight parts |
| Guanamine solution | (Solid content 70 weight %) | 12.4 weight parts |
| Acidic catalyst | (Solid content 40 weight %) | 0.22 weight parts |

-continued

| | | |
|---|---|---|
| Silicon resin solution | [Solid content 20 weight % (SR2410: manufactured by Toray Dow Corning Silicone)] | 185.8 weight parts |
| Amino silane | [Solid content 100 weight % (SH6020: manufactured by Toray Dow Corning Silicone)] | 0.42 weight parts |
| Inorganic oxide microparticles B | Aluminum oxide, particle diameter: 0.37 μm, absolute specific gravity: 3.9, particle powder specific resistance: $10^{13}$ Ω · cm] | 60 weight parts |
| Toluene | | 800 weight parts |

Other than modifying the carrier 1 used in Example 3 above to carrier 5, evaluations were conducted with the same toner as in Example 3, and under the same conditions (amount of developer carried mean value 32 [mg/cm$^2$]) as in Example 3.

EXAMPLE 11

Using the microparticles in Example 3, 100 g of hydrophobic silica microparticles with a mean particle diameter of 30 [nm], 100 g of hydrophobic titanium oxide microparticles with a mean particle diameter of 30 [nm], and 75 g of hydrophobic silica microparticles with a mean particle diameter of 100 [nm] were added to 20 kg of the microparticles, and were agitated and mixed to obtain magenta electronic photography toner (Dw/Dn: 1.12). Evaluations were conducted using the same carrier as Example 1 and under the same conditions as in Example 1.

EXAMPLE 12

Using the toner of Example 3 above and the carrier of Example 1, a developer with a toner concentration (TC) of 5 [wt %] was prepared, and evaluations were conducted in actual equipment using an IPSiO Color Model 8100 printer manufactured by Ricoh (blast type developing sleeve with a surface roughness Rz: 35 [μm], Sm: 100 [μm], DG: 0.3 [mm], amount of developer carried mean value: 30 [mg/cm$^2$], PG: 0.3 [mm]). The paper passage conditions were: image area percentage: 5%, duty: 100K sheets at 1 P/J.

EXAMPLE 13

Using the toner of Example 3 above and the carrier of Example 1, a developer with a toner concentration (TC) of 5 [wt %] was prepared, and evaluations were conducted in actual equipment using an IPSiO Color Model 8100 printer manufactured by Ricoh (blast type developing sleeve with a surface roughness Rz: 30 [μm], Sm: 200 [μm], DG: 0.9 [mm], amount of developer carried mean value: 50 [mg/cm$^2$], PG: 0.3 [mm]). The paper passage conditions were: image area percentage: 5%, duty: 100K sheets at 1 P/J.

EXAMPLE 14

Using the toner of Example 3 above and the carrier of Example 1, a developer with a toner concentration (TC) of 5 [wt %] was prepared, and evaluations were conducted in actual equipment using an IPSiO Color Model 8100 printer manufactured by Ricoh (blast type developing sleeve with a surface roughness Rz: 30 [μm], Sm: 170 [μm], DG: 0.9 [mm], amount of developer carried mean value: 60 [mg/cm$^2$], PG: 0.3 [mm]). The paper passage conditions were: image area percentage: 5%, duty: 100K sheets at 1 P/J.

COMPARATIVE EXAMPLE 1

Using the color toner obtained in Example 1 above and carrier 1, a developer with a toner concentration (TC) of 5 [wt %] was prepared, and evaluations were conducted in actual equipment using an IPSiO Color Model 8100 printer manufactured by Ricoh (surface roughness Rz: 40 [μm], Sm: 120 [μm], DG: 0.3 [mm], amount of developer carried mean value: 45 [mg/cm$^2$], PG: 0.4 [mm]). The paper passage conditions were: image area percentage: 5%, duty: 100K sheets at 1 P/J.

COMPARATIVE EXAMPLE 2

Using the toner and carrier in Example 2 above, evaluations were conducted under the same conditions as in Comparative Example 1.

COMPARATIVE EXAMPLE 3

Using the toner and carrier in Example 3 above, evaluations were conducted under the same conditions as in Comparative Example 1.

COMPARATIVE EXAMPLE 4

Using the toner of Example 1 above and the carrier of Example 1, a developer with a toner concentration (TC) of 5 [wt %] was prepared, and evaluations were conducted in actual equipment using an IPSiO Color Model 8100 printer manufactured by Ricoh (surface roughness Rz: 25 [μm], Sm: 200 [μm], DG: 0.3 [mm], amount of developer carried mean value: 25 [mg/cm$^2$], PG: 0.3 [mm]). The paper passage conditions were: image area percentage: 5%, duty: 100K sheets at 1 P/J.

COMPARATIVE EXAMPLE 5

Using the toner of Example 3 above and the carrier of Example 1, a developer with a toner concentration (TC) of 5 [wt %] was prepared, and evaluations were conducted in actual equipment using an IPSiO Color Model 8100 printer manufactured by Ricoh (surface roughness Rz: 28 [μm], Sm: 200 [μm], DG: 0.9 [mm], amount of developer carried mean value: 65 [mg/cm$^2$], PG: 0.3 [mm]). The paper passage conditions were: image area percentage: 5%, duty: 100K sheets at 1 P/J.

COMPARATIVE EXAMPLE 6

Using the toner of Example 3 above and the carrier of Example 1, a developer with a toner concentration (TC) of 5 [wt %] was prepared, and evaluations were conducted in actual equipment using an IPSiO Color Model 8100 printer manufactured by Ricoh (surface roughness Rz: 22 [μm], Sm: 200 [μm], DG: 0.9 [mm], amount of developer carried mean value: 60 [mg/cm$^2$], PG: 0.25 [mm]). The paper passage conditions were: image area percentage: 5%, duty: 100K sheets at 1 P/J.

COMPARATIVE EXAMPLE 7

Changing the crushing and microparticle classification conditions when preparing the toner in Example 1 above, microparticles with a weight mean particle diameter of 7.5 μm, a percentage of particles 3 μm or less of 21%, and an average circularity of 0.934 were obtained. One hundred grams of hydrophobic silica microparticles with a mean particle diameter of 30 [nm], and 100 g of hydrophobic titanium oxide microparticles with a mean particle diameter of 30 [nm] were added to 20 kg of the microparticles, and were agitated and mixed to obtain magenta electronic photography toner (Dw/Dn: 1.24). Evaluations were conducted using the same carrier as Example 1 and under the same conditions as in Example 1.

The charge stability, developer dropping, toner scattering, amount of developer carried, and image quality were evaluated for Examples 1 to 14 and for Comparative Examples 1 to 7.

Charge stability (amount of decrease) means the amount when the amount of charge (Q1), wherein a sample mixed at a percentage of 5 weight % toner to 95 weight % initial carrier and undergoes frictional charging is measured using a general blow off method [manufactured by Toshiba Chemical (Co., Ltd.): TB-200] is subtracted from the amount of charge (Q2), wherein the carrier obtained by using the aforementioned blow off device to eliminate the toner in the developer after running is measured by the same method as that described above. The target value is within 10.0 (μc/g).

The determination of developer dropping was made based on the contamination conditions at the bottom of the developing device after each 20K sheets of paper pass through. If any developer dropping was observed, the determination was "x". Moreover, even when developer dropping was observed, if there was no damage to the working life of the photosensitive drum and slightly abnormal images were generated, the evaluation was carried over.

Toner scattering is determined by measuring the weight of the toner retained in the bottom of the developing device every 20K sheets of paper that pass through, and by making the calculations after 100K sheets of paper have passed through. As a determination criterion, 500 [mg] or less is the permissible level.

Regarding the amount of developer carried, after driving the developing device for 30 [sec], the total average value is calculated by measuring the 3 locations of front, center and back in the main scan direction on the developing sleeve 3 times. The amount carried is handled using the integer value obtained by rounding off one decimal place. As a determination criterion, the initial value is compared with the value after 100K sheets of paper have passed through, and a fluctuation range of within 7 [mg/cm$^2$] is permissible.

Regarding the image quality evaluation, the highlight part was evaluated by uniformity. The granularity (brightness range: 50 to 80) defined by the following equation was measured, and the results were displayed by substituting the following ranks for the numeric values (rank 10 is the best).

$$\text{Granularity}=\exp(aL+b)\int\{WS(f)\}1/2\,VTF(f)df$$

L: Average brightness
f: Space cycle (cycle/mm)
WS(f): Brightness fluctuation power spectrum
VTF(f): Visual space frequency characteristics
a,b: Coefficients
<Rank>
Rank 10: −0.10 to 0
Rank 9: 0 to 0.05
Rank 8: 0.05 to 0.10
Rank 7: 0.10 to 0.15
Rank 6: 0.15 to 0.20
Rank 5: 0.20 to 0.25
Rank 4: 0.25 to 0.30
Rank 3: 0.30 to 0.40
Rank 2: 0.40 to 0.50
Rank 1: 0.50 or more
Rank 7 and above is the permissible level.

As indicated in FIG. 10, Examples 1 to 14 were in the permissible level for image quality (highlight uniformity) both initially and after outputting 100K pages of images in relation to the criteria of a (DG gap between the developer restricting member and the developing sleeve/PG developing gap) in the range of 1 to 3, an amount of developer initially carried of 30 to 60 [mg/cm$^2$], a toner weight mean particle diameter of 4.5 to 8.0 [μm], a (Dw/Dn) of 1.20 or less; and a developer sleeve surface roughness of (Rz: 20 to 40 μm, Sm: 100 to 200 μm). Moreover, there was no developer dropping; and toner scattering, changes in amount carried, and charge stability were all at permissible levels.

On the other hand, the DG/PG of 0.8 for Comparative Examples 1 to 3 was below the permissible levels for initial image quality. Because the PG was narrower than the DG, the thickness of the developer layer after passing through the developer restricting member became thinner than the developing gap PG. As a result, irregularities were produced in the contract pressure of the developer with the photoconductive member, leading to concentration irregularities in the development region. Apparently this resulted in the initial highlight uniformity falling below the permissible level. Moreover, toner scattering and change in amount carried also fell below the permissible levels, and the image quality after 100K sheets declined by a large margin. Because the contact pressure of the developer with the photoconductive member was not sufficient, and because the image concentration decreased, during image concentration control, toner was supplied and the toner concentration of the developer was heightened to restore the image concentration. As a result, in Comparative Examples 1 to 3, the toner concentration after 100K sheets becomes higher than the initial toner concentration. In this way, when the toner concentration is heightened, the amount of developer charge declines and greater toner scattering occurs. As a result, in Comparative Examples 1 to 3, 500 [mg], which is the permissible level of toner scattering, was exceeded.

In addition, the contact pressure between the photoconductive member and the developer became less and less uniform because the amount of developer carried decreased by a large margin, and apparently as a result, the highlight uniformity after 100K sheets fell by three ranks. The details of the large decline in the amount of developer carried are not certain, but apparently this was because the toner concentration increased and the fluidity of the developer decreased.

Moreover, in Comparative Example 4, because the initial amount of developer carried was 30 [mg/cm$^2$] or less, the amount of developer supplied to the development region was small. For this reason, the image concentration was thin, producing irregularities in the contract pressure of the developer with the photoconductive member, leading to concentration irregularities. Apparently this resulted in the deterioration of the initial highlight uniformity. In addition, by controlling the image concentration because the image concentration was thin, the developer concentration was heightened. As a result, toner scattering became greater because the amount of developer charge decreased. Consequently, in Comparative Example 4 as well, toner scattering fell below the permissible level.

In Comparative Example 5, because the initial amount of developer carried was 60 [mg/cm$^2$] or more, blanking and scratches were produced and the initial highlight uniformity decreased. In addition, in Comparative Example 5, the thickness of the developing sleeve layer increased because the DG was set at 0.9 [mm]. Because the layer was thick in this way, as indicated in FIG. 4, the gap between the opening 53*a* of the developer case 53 and the developing sleeve became large. In Examples 5, 13 and 14, which had a large gap between the opening 53*a* of the developer case 53 and the developing sleeve in the same way because the DG was set at 0.9 [mm], little toner, which was agitated by the agitation screw, etc., leaked out from the gap between the opening 53*a* and the developing sleeve because the toner charge was high and the toner concentration was kept low. However, in Comparative Example 5, a large amount of toner, which was agitated by the agitation screw, etc., leaked out from the gap between the opening 53*a* and the developing sleeve, raising toner scattering above the permissible level.

In Comparative Example 6, the developer layer after passing through the developer restricting member became thicker than the developing gap PG because the DB/PG was 3.0 or more. As a result, initial developer retention was produced. As a result of producing this kind of developer retention, the amount of developer transported to the developing region became unstable. Apparently as a result, concentration irregularities were produced in the image, and the initial uniformity fell below the permissible level. Moreover, because developer retention was produced in this way, developer dropping was generated in Comparative Example 6.

In addition, in Comparative Example 6, toner adhered to the developing sleeve because developer retention had occurred. As a result, in addition to the factor of the amount of developer transported to the developing region becoming unstable, the loss of uniformity in the electric field between the photoconductive member and the developing sleeve became a second factor that worsened the concentration irregularities. Apparently, the highlight uniformity after 100K sheets became notably low for this reason. In addition, developer retention appears to have produced toner scattering, and thus toner scattering fell below the permissible level.

In Comparative Example 7, the reduction of developer fluidity caused by stress was accelerated because the (Dw/Dn) was 1.20 or more. When the fluidity of the developer deteriorates in this way, the developer apparently has difficulty passing through the narrow developing gap PG, developer retention is produced, and developer dropping occurs. In addition, the developer transport capacity of the developing sleeve and the charge stability decrease dramatically because the fluidity has worsened notably. For this reason, the developer fluctuation range became 7 or more and the charge stability also increased to 10 [μc/g] or more, thus falling below the permissible level. Moreover, the amount of developer transported to developing region decreased and the image concentration fell because of the drop in the carrying capacity of the developing sleeve. For this reason, as a result of increasing toner concentration in the developer, decreasing charge of the developer, and greater toner scattering, toner scattering fell below the permissible level. Moreover, because developer retention was generated, toner adhered to the developing sleeve and a stable supply of developer to the developing region has inhibited by developer retention as occurred in Comparative Example 6, and therefore highlight uniformity decreased notably after 100K sheets. In addition, with a broad particle diameter distribution, toner with an average particle circularity of less than 0.95 was used, resulting in highlight uniformity falling below the permissible level because images with poor granularity were produced even in the initial period.

Next, Examples 1, 2, 3, and 11, which have differing toner characteristics respectively, will be explained. As can be understood from FIG. 10, the uniformity in Example 2 is greater than that in Example 1, and the uniformity in Examples 3 and 11 is greater than that in Example 2. That is, the percentage of particles 3 μm or less is 5% or more in the toner particle size distribution of Example 1, and in contrast, the percentage of particles 3 μm or less is 5% or less in the toner particle size distributions of Examples 2, 3, and 11. For this reason, compared to Example 1, the image granularity is higher and the highlight uniformity is greater in Examples 2, 3, and 11.

In addition, in contrast to the average circularity of 0.95 or less in Example 2, and the average circularity in Examples 3 and 11 is 0.95 or more, and therefore the image granularity is higher than in Example 2, and Example 3 and 11 has the greater highlight uniformity.

As indicated in Examples 4 and 11, by using polymer toner with an average circularity of 0.95 or more and a percentage of particles 3 μm or less of 5% or less in the toner particle size distribution, even if the amount of developer carried is 30 [mg/cm$^2$] or less, images with high granularity are obtained and the highlight uniformity is excellent.

When confirming the images of Example 11, the blurriness was improved compared to the other Examples. This appears to be because 80 to 140 [nm] hydrophobic silica was added to Example 11, thereby improving blurring during transfer.

Next, Examples 3, 7, 8, 9, and 10, which had differing carrier characteristics respectively, will be explained. As can be understood from FIG. 10, Example 10 had poorer highlight uniformity and toner scattering than the other examples (Examples 3, 7 to 9). Scumming and poor highlight uniformity apparently occurred because the weight mean particle diameter of the carrier in Example 10 was 71 [μm], which is greater than 45 [μm].

In addition, the volume resistance of the carrier in Example 8 was 12[Log (Ω·cm)] or less, and therefore the toner scattering was worse than in the other examples.

The cleaning blade in Example 9 had more abrasion than the cleaning blades in the other examples. When confirming the images in Example 9, white spots were confirmed in the images. Apparently carrier adhesion to the photoconductive member had occurred because the carrier particle diameter in Example 9 was 20 μm or less.

From the above, according to the developing device of the present embodiment, concentration irregularities, scratches, blanking and the like can be suppressed, and high resolution, high grade images can be obtained by having a toner mean particle diameter of 8 [μm] or less, a developer carrier surface with an irregular rough surface, and an amount of developer carried of 30 [mg/cm$^2$] or more and 60 [mg/cm$^2$] or less. Then, a reduction in the fluidity of the developer can be suppressed by having a toner particle diameter distribution (Dw/Dn) of 1.20 or less, and a toner weight mean particle diameter of 4.5 [μm] or more. Further, a stable amount of developer carried can be guaranteed by making a developing sleeve, which is the developer carrier, that has a maximum roughness height Rz of 20 to 40 [μm] and a mean roughness space Sm of 100 to 200 [μm]. Moreover, developer retention and toner adhesion to the developer carrier can be suppressed by having a DG/PG in the range of 1 to 3. High resolution, high grade images can thereby be supported over a long period of time.

In addition, an excellent developing electric field can be formed between the photoconductive member and the developing sleeve by having a developer gap PG of 0.25 [mm] or more and 0.35 [mm] or less; and loss of uniform toner adhesion caused by a returning electrical field can be controlled and the generation of image concentration irregularities can be suppressed. Further, contact between the developing sleeve 54 and the photoconductive member 4 with developer caught in between caused by minute fluctuations of the gap, the packing of toner in between these members, and toner adhering to the developing sleeve 54 can be suppressed.

An effect can be obtained to suppress the progressive scraping of film off of the surface of the carrier, and a rapid decrease in carrier resistance can be controlled by containing aluminum oxide particles on the core material of the magnetic particle carrier.

Added image concentration stability and improved resolution can be sought and heightened image quality can be obtained by making the weight mean particle diameter of the carrier be 20 [μm] or more and 45 [μm] or less.

Moreover, loss of uniform toner adhesion caused by a returning electrical field can be controlled and carrier adhesion can be suppressed by having a carrier volume resistance of 12 [log (Ω·cm)] or more and 16 [log (Ω·cm)] or less.

High level dot reproducibility can be obtained by using a toner with an average circularity of 0.95 or more.

In addition, there is a notable effect to improve the quality of fluidity and storage characteristics by making the percentage of particles 3 μm or less be 5% or less in the toner particle size distribution, and a satisfactory level can be obtained for the characteristics of supplementing toner into the developing device and for the toner charge startup characteristics.

Added to the toner was 0.3 [wt %] or more and 1.5 [wt %] or less of hydrophobic silica particles with a mean particle diameter of 50 [nm] or less, as well as 0.2 [wt %] or more and 1.2 [wt %] or less of hydrophobic titanium oxide particles with a mean particle diameter of 50 [nm] or less as fluidizers. When agitating and mixing, the electrostatic force and van der Waals force could thereby be dramatically improved. Consequently, excellent image quality without separation of the fluidizer from the toner can be obtained by agitating and mixing inside the developing device, which is conducted in order to obtain the specified charge level. Moreover, a reduction of toner remaining after transfer may be anticipated.

Further, fluidizer comprising hydrophobic silica particles with a mean particle diameter of 80 [nm] or more and 140 [nm] or less may be added. An effect to reduce the adhesive force between toner particles can thereby be obtained, and not only can transfer characteristics be improved, but transfer irregularities that are prone to be produced locally when outputting a low area image can be suppressed. Consequently, there is a notable effect to improve the quality o the images, and excellent image quality can be obtained over a long period of time.

The generation of leaks between the photoconductive member 4 and the developing sleeve 54 can be suppressed and the generation of blurry images can be controlled by making a direct current developing bias comprising only the direct current component.

Various modifications will become possible for those skilled in the art after receiving the teachings of the present disclosure without departing from the scope thereof.

What is claimed is:

1. A developing device, comprising:

a developer carrier that is provided opposite to an image carrier supporting a latent image on the surface, that supports a two-component developer comprising magnetic particles and toner on the surface, and that forms a developing gap between the image carrier, the developing device developing the latent image by moving the toner on the developer carrier to the image carrier side, wherein the amount of developer carried per unit area on the developer carrier is 30 mg/cm$^2$ or more and 60 mg/cm$^2$ or less in a developing region where toner on the developer carrier is moved to the image carrier side;

the weight mean particle diameter of the toner is 4.5 μm or more and 8.0 μm or less, and the ratio Dw/Dn of the toner weight mean particle diameter (Dw) and the number mean particle diameter (Dn) is 1.20 or less;

the maximum height Rz of the surface roughness of the developer carrier is 20 to 40 μm, the mean space Sm of the roughness of the developer carrier surface is 100 to 200 μm, and the surface roughness of the developer carrier has an irregular height and space roughness pattern; and the value, which is obtained by dividing the gap DG between the developer carrier and a developer restricting member provided opposite to the developer carrier and restricting the amount of developer transported to the development region, by the developing gap PG between the image carrier and the developer carrier, is 1.0 or more and 3.0 or less.

2. The developing device as claimed in claim 1, wherein the gap GP between the image carrier and the developer carrier is 0.25 mm or more and 0.35 mm or less.

3. The developing device as claimed in claim 1, wherein the magnetic particles comprise magnetic particles containing aluminum oxide particles on the core material of the magnetic particles.

4. The developing device as claimed in claim 1, wherein the magnetic particles comprise magnetic particles with a weight mean particle diameter of 20 μm or more and 45 μm or less.

5. The developing device as claimed in claim 1, wherein the magnetic particles comprise magnetic particles with a volume resistance value of 12 log(Ω·cm) or more and 16 log (Ω·cm) or less.

6. The developing device as claimed in claim 1, wherein the toner comprises a toner with an average circularity of 0.95 or more.

7. The developing device as claimed in claim 1, wherein the toner comprises a toner with a percentage of particles of 3 μm or less, of 5 or less.

8. The developing device as claimed in claim 1, wherein the toner comprises a toner to which 0.3 wt % or more and 1.5 wt % or less of hydrophobic silica microparticles with a mean particle diameter of 50 nm or less, and 0.2 wt % or more and 1.2 wt % or less of hydrophobic titanium oxide with a mean particle diameter of 50 nm or less are added as fluidizers.

9. The developing device as claimed in claim 1, wherein the toner comprises a toner to which hydrophobic silica microparticles with a mean particle diameter of 80 nm or more and 140 nm or less is added as a fluidizer.

10. The developing device as claimed in claim 1, wherein the developer carrier is provided with developing bias application means for applying direct current developing bias comprising only a direct current component.

11. An image forming apparatus comprising a developing device, wherein the developing device comprises a developer carrier that is provided opposite to an image carrier supporting a latent image on the surface, that supports a two-component developer comprising magnetic particles and toner on the surface, and that forms a developing gap between the image carrier, the developing device develops the latent image by moving the toner on the developer carrier to the image carrier side, the amount of developer carried per unit area on the developer carrier is 30 mg/cm$^2$ or more and 60 mg/cm$^2$ or less in a developing region where toner on the developer carrier is moved to the image carrier side;

the weight mean particle diameter of the toner is 4.5 μm or more and 8.0 μm or less, and the ratio Dw/Dn of the toner weight mean particle diameter (Dw) and the number mean particle diameter (Dn) is 1.20 or less;

the maximum height Rz of the surface roughness of the developer carrier is 20 to 40 μm, the mean space Sm of the roughness of the developer carrier surface is 100 to 200 μm, and the surface roughness of the developer carrier has an irregular height and space roughness pattern; and the value, which is obtained by dividing the gap DG between the developer carrier and a developer restricting member provided opposite to the developer carrier and restricting the amount of developer transported to the development region, by the developing gap PG between the image carrier and the developer carrier, is 1.0 or more and 3.0 or less.

12. The image forming apparatus as claimed in claim 11, wherein full color images are formed using a developing device comprising yellow developer, a developing device comprising magenta developer, a developing device comprising cyan developer, and a developing device comprising black developer.

* * * * *